US007926406B2

(12) United States Patent
Warren et al.

(10) Patent No.: US 7,926,406 B2
(45) Date of Patent: Apr. 19, 2011

(54) METHODS AND APPARATUS FOR PROVIDING BALLISTIC PROTECTION

(75) Inventors: David H. Warren, Stone Ridge, NY (US); Wayne Schaeffer, Stone Ridge, NY (US)

(73) Assignee: Armordynamics, Inc., Stone Ridge, NY (US)

( * ) Notice: Subject to any disclaimer, the term of this patent is extended or adjusted under 35 U.S.C. 154(b) by 400 days.

(21) Appl. No.: 11/979,310

(22) Filed: Nov. 1, 2007

(65) Prior Publication Data

US 2011/0005378 A1 Jan. 13, 2011

Related U.S. Application Data

(62) Division of application No. 11/296,402, filed on Dec. 8, 2005, now Pat. No. 7,383,761.

(60) Provisional application No. 60/634,120, filed on Dec. 8, 2004, provisional application No. 60/689,531, filed on Jun. 13, 2005.

(51) Int. Cl.
*F41H 5/04* (2006.01)
*F41H 5/013* (2006.01)

(52) U.S. Cl. ..... 89/36.01; 86/50; 52/284

(58) Field of Classification Search ..... 89/36.01; 86/50; 52/284, 286
See application file for complete search history.

(56) References Cited

U.S. PATENT DOCUMENTS

| | | | | |
|---|---|---|---|---|
| 3,529,389 | A * | 9/1970 | Wilkins | 174/497 |
| 4,186,648 | A * | 2/1980 | Clausen et al. | 89/36.02 |
| 5,164,536 | A * | 11/1992 | Barbaza et al. | 89/36.11 |
| 6,713,008 | B1 * | 3/2004 | Teeter | 264/258 |
| 2001/0031350 | A1 * | 10/2001 | Day et al. | 428/317.9 |

* cited by examiner

*Primary Examiner* — Stephen M Johnson
(74) *Attorney, Agent, or Firm* — Andrews Kurth LLP

(57) ABSTRACT

Methods and apparatus for providing ballistic protection and stopping high-velocity rounds or explosives and for constructing protective structures. The apparatus includes a building block, one or more ballistic panels configured to fit within the building block, each ballistic panel includes a three-dimensional core that acts as a truss for the ballistic panel, and a filler. The filler fills in spaces defined by each three-dimensional core and any empty spaces in the building block. The one or more ballistic panels and the filler are inserted into the building block. The building block is shaped to interlock with other building blocks.

12 Claims, 23 Drawing Sheets

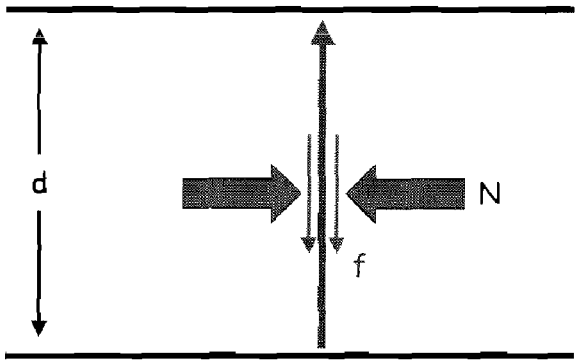
DIAGRAM 1
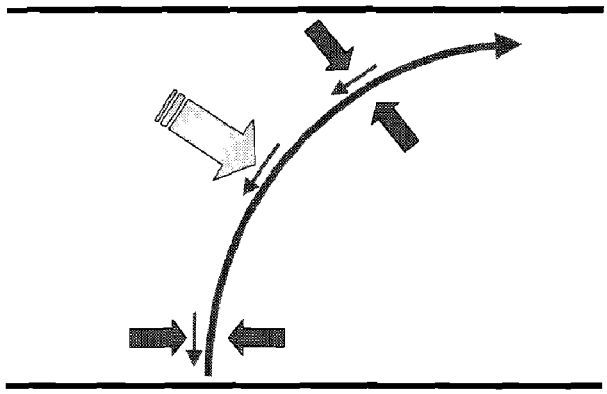
DIAGRAM 2

METHODS AND APPARATUS FOR PROVIDING BALLISTIC PROTECTION

CROSS-REFERENCE TO RELATED APPLICATIONS

This application is a divisional of U.S. patent application Ser. No. 11/296,402, filed Dec. 8, 2005 now U.S. Pat. No. 7,383,761, entitled "METHODS AND APPARATUS FOR PROVIDING BALLISTIC PROTECTION", which claimed the priority of U.S. Provisional Application Ser. No. 60/634,120, filed Dec. 8, 2004, entitled "METHOD AND APPARATUS FOR PROVIDING A BALLISTIC SHIELD AND METHOD OF MAKING SAME," and U.S. Provisional Application Ser. No. 60/689,531, filed Jun. 13, 2005, entitled "METHOD AND APPARATUS FOR PROVIDING BALLISTIC PROTECTIVE MATERIAL AND METHOD OF MAKING SAME," all of which are hereby incorporated by reference in their entirety.

BACKGROUND

Given the current situation in Iraq and other hotspots around the world, a real need ballistic protective material that is lightweight, cost effective, field ready, and rapidly deployable would be advantageous. While some combat vehicles are protected, many are not and the current situation in Iraq is that roadside bombs and high velocity projectiles are leaving many soldiers wounded.

Many ask the question 'Why aren't military vehicles in Iraq and other places more protected?' The answer seems to be that war is changing. It use to be that tanks came under heavy fire but now wheeled vehicles such as, e.g., HMMVs, FMTV's, 5-Ton and 2½-Ton Trucks come under heavy fire. These types of vehicles are often targets for insurgents in Iraq, and elsewhere, interested in creating instability. These forces work behind the scenes and instead of launching a clear attack, seem satisfied to cause havoc by using roadside bombs and independent strikes.

There are stories pouring out of Iraq that military personnel are buying armor over the internet or attempting to create their own makeshift armor in an effort to survive. It is widely agreed upon that the military is not prepared for this new type of fighting and that military personnel are trying their best to survive. A better solution is needed. Conventional armor (steel) is too time consuming, expensive and heavy (reduces the vehicle's efficiency and makes it difficult to transport the vehicle) to adequately solve the problem. While ballistic products are readily available in the United States, many are quite expensive and others are not field ready.

SUMMARY

Methods and apparatus overcome disadvantages described above. Embodiments of the methods and apparatus provide lightweight, cost effective, field ready, and rapidly deployable ballistic protective material. Embodiments of the method and apparatus also have the advantage of being easy to manufacture and are made of readily-available materials.

These and other advantages may be provided by an apparatus for constructing protective structures. The apparatus includes a building block, one or more ballistic panels configured to fit within the building block, each ballistic panel includes a three-dimensional core including node cells, and a filler. The filler fills in the node cells of the three-dimensional core and any empty spaces in the building block. The one or more ballistic panels and the filler are inserted into the building block. The building block is shaped to interlock with other building blocks.

These and other advantages may be provided by an apparatus for constructing protective structures. The apparatus includes a building block, one or more ballistic panels configured to fit within the building block, each ballistic panel includes a three-dimensional core that acts as a truss for the ballistic panel, and a filler. The filler fills in spaces defined by each three-dimensional core and any empty spaces in the building block. The one or more ballistic panels and the filler are inserted into the building block. The building block is shaped to interlock with other building blocks.

BRIEF DESCRIPTION OF DRAWINGS

Diagram 1 illustrates a bullet entering a piece of minor.

Diagram 2 illustrates that an armor changes the direction of a bullet immediately after the bullet pierces the outside of the armor.

The detailed description will refer to the following drawings, wherein like numerals refer to like elements, and wherein:

FIGS. 1A-1D are diagrams a side, cross-sectional view of an embodiment of ballistic panel.

FIGS. 2A-2B are diagrams illustrating a side, cross-sectional view of an embodiment of core used in an embodiment of ballistic panel.

FIG. 2C is a partial top view of an embodiment of core used in an embodiment of ballistic panel.

FIG. 2D is a partial top perspective view of an embodiment of core used in an embodiment of ballistic panel.

FIG. 3 is a diagram illustrating an exemplary seat/personal shield embodiment of ballistic panel.

FIGS. 4A-4B and 5A-5B are diagrams illustrating an embodiment of ballistic panel with strapping.

FIG. 6 is a diagram illustrating a door panel embodiment of ballistic panel with a viewer.

FIG. 7 is a flowchart of an embodiment of method of making ballistic panel.

FIG. 8 is a perspective top view of an embodiment of core of ballistic panel.

FIG. 9 is an illustration of a top view of an embodiment of core of ballistic panel filled in with an embodiment of ceramic layer.

FIG. 10 is an illustration of a top view of an embodiment of core of ballistic panel filled in with an embodiment of ceramic layer and bonding media.

Figure 11:
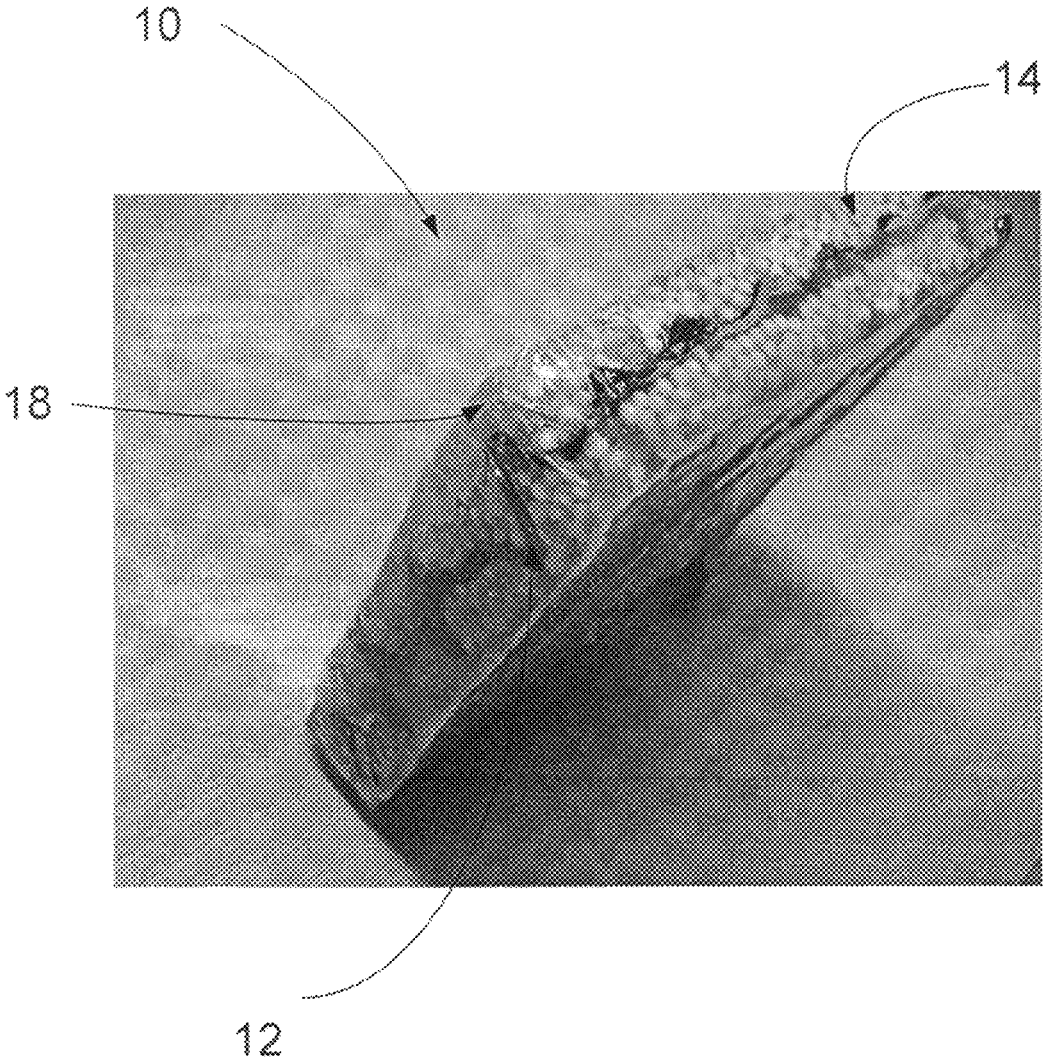

FIG. 11 is an illustration of a side perspective view of an embodiment of ballistic panel.

Figure 12A:
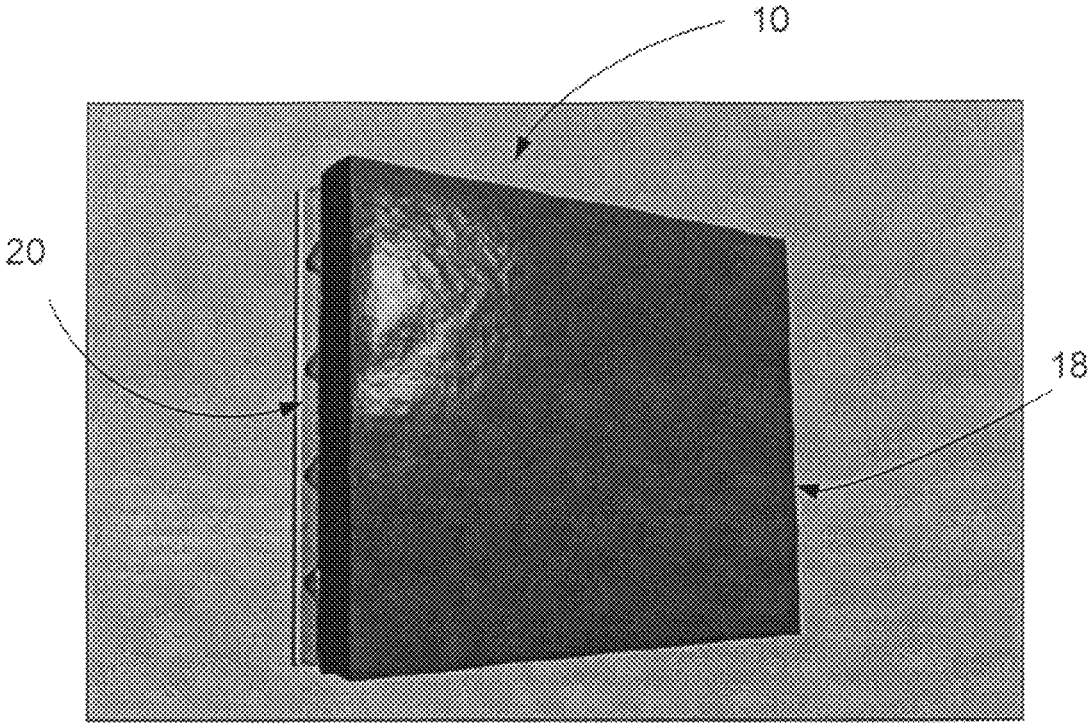
Figure 12B:
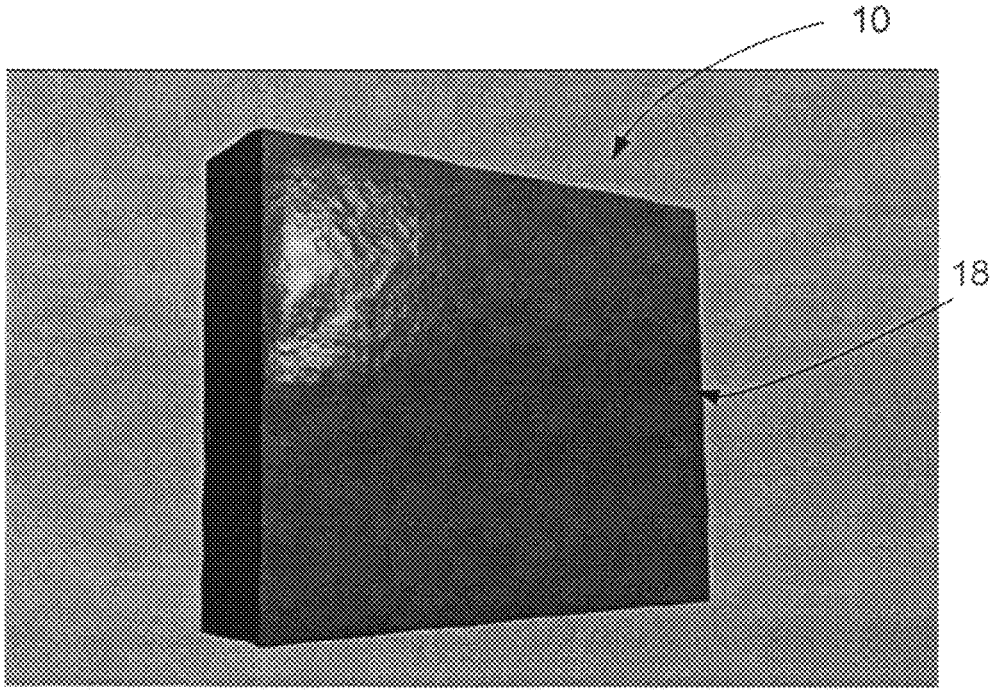

FIGS. 12A-12B are diagrams illustrating a perspective view of application of outer layer of an embodiment ballistic panel.

Figure 13A:
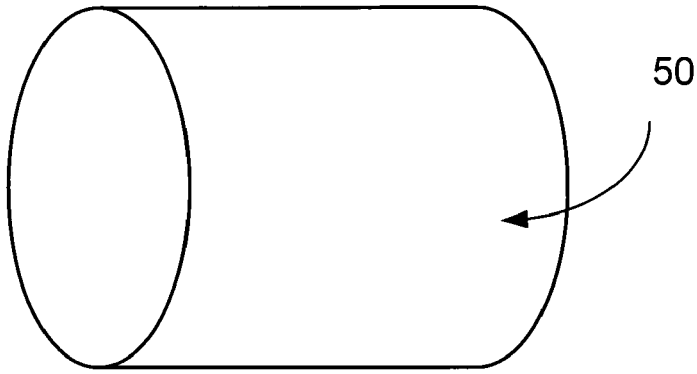
Figure 13B:
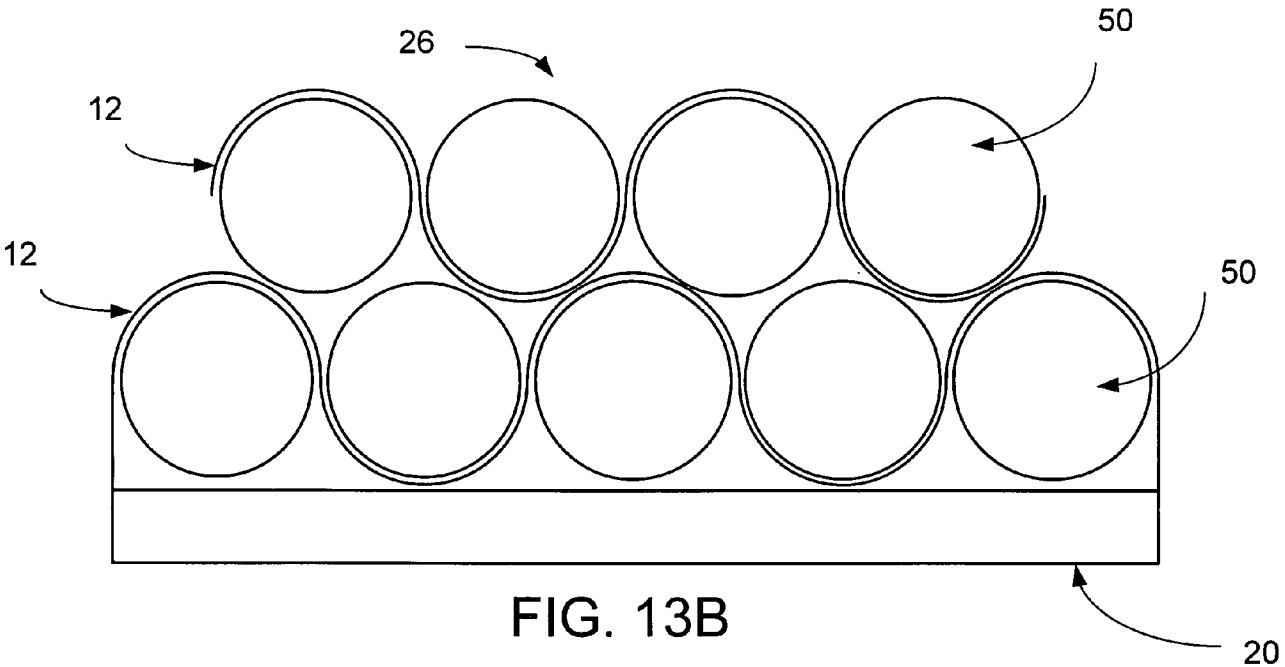
Figure 13C:
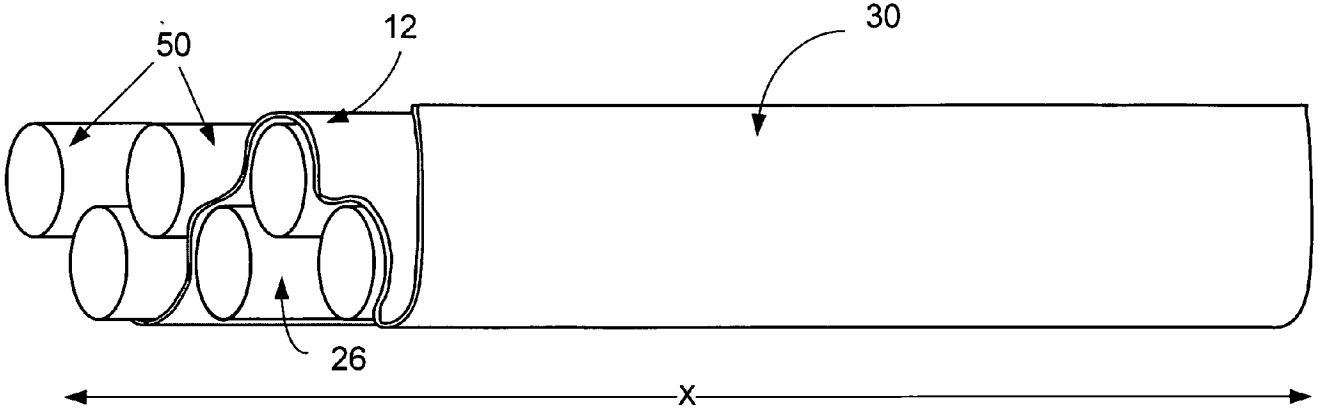

FIGS. 13A-13C are diagrams illustrating an embodiment of ceramic layer and corresponding core of ballistic panel.

Figure 14A:
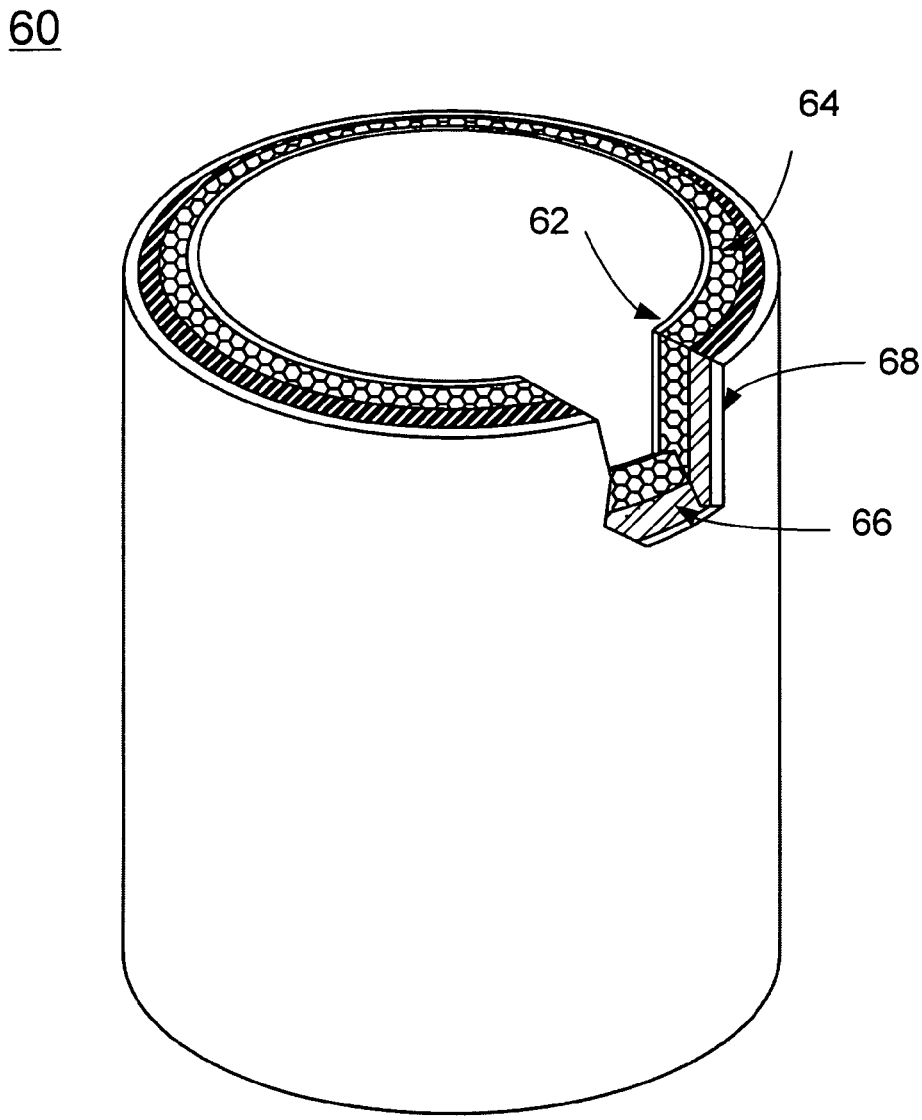
Figure 14B:
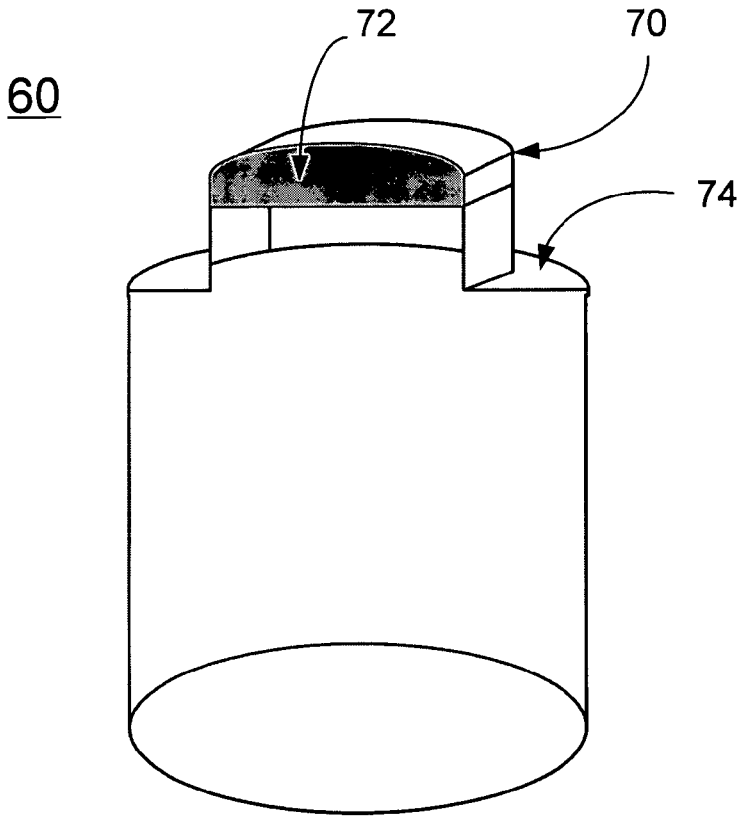

FIGS. 14A-14B are diagrams illustrating an embodiment of a secure can including ballistic panel.

FIGS. 15A-15D are diagrams illustrating an embodiment of building blocks included ballistic panel.

FIG. 16 illustrates a bullet entering a piece of armor.

FIG. 17 illustrates that an armor changes the direction of a bullet immediately after the bullet pierces the outside of the armor.

DETAILED DESCRIPTION

Methods and apparatus for providing ballistic protection and stopping high-velocity rounds or explosives are described herein. Systems incorporating such apparatus are also described herein. Embodiments of the methods and apparatus provide a light-weight ballistic panel that is an effective barrier or shield against high-velocity rounds or explosives. Various embodiments of ballistic panel are self-healing, able to withstand multiple attacks, portable, easy to install, absorb instead of deflecting rounds, relatively light-weight, and inexpensive.

Figure 1A:
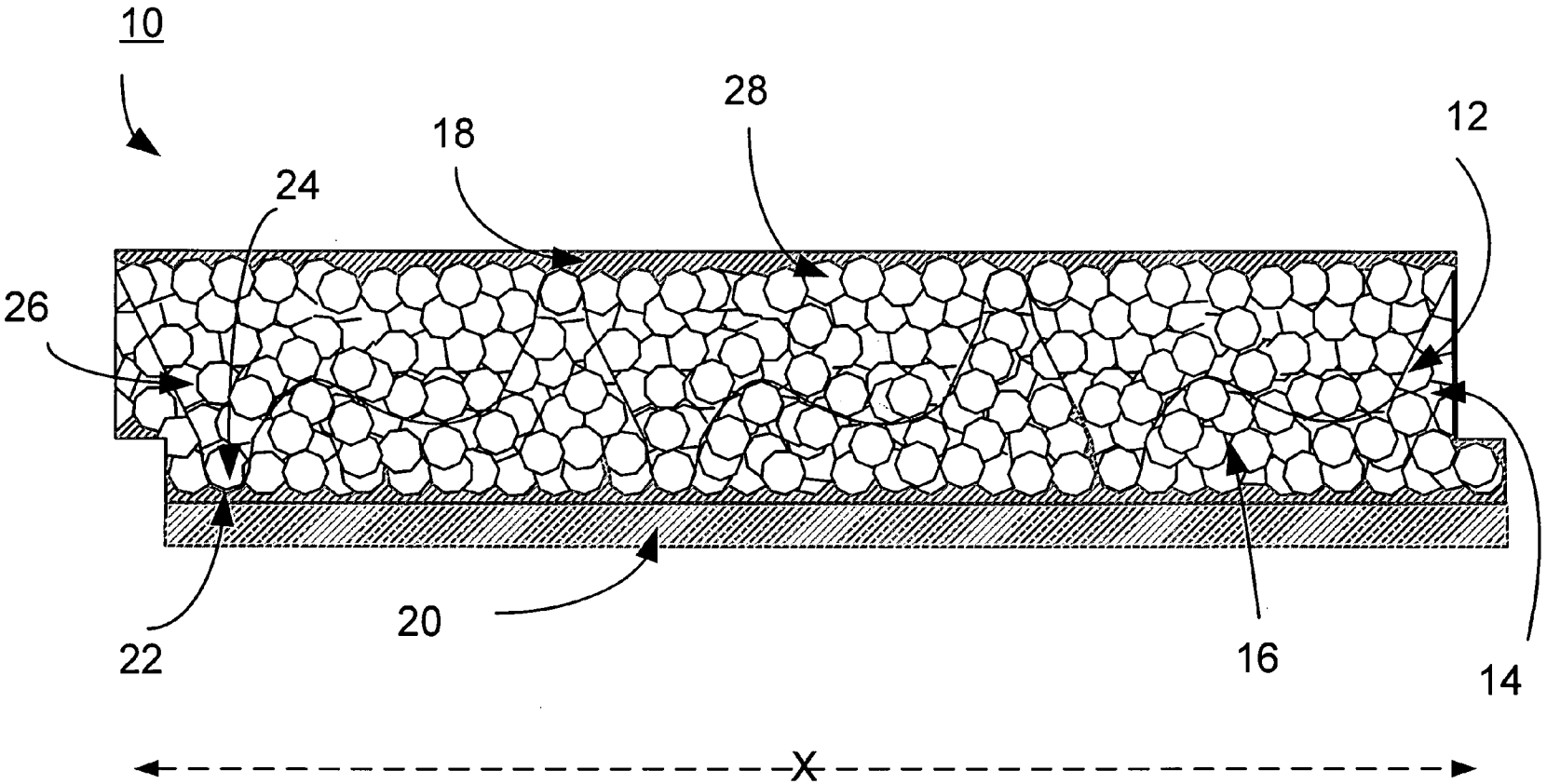

With reference now to FIG. 1A, a cross-sectional view of an embodiment of ballistic panel 10 is shown. Ballistic panel 10 comprises: (1) core 12, (2) ceramic layer 14 (e.g., ceramic spheres, beads or balls) as a medium or filler (3) bonding media 16 (e.g., casting urethane) that bonds ceramic layer and (4) outer coating 18 (e.g., a self-healing polymer). The materials combine to create an excellent shield for stopping multiple high-velocity rounds. Embodiments of ballistic panel 10 used in applications in which ballistic panel 10 is not mounted on a material with sufficient force-absorbing or force-resistant principles, e.g., wood, aluminum, hardened plastic, concrete, brick, aluminum or other metal, or composite materials, may also comprise (5) backing 20 made from such materials.

Ballistic panel 10 can be made in almost any size or shape. For example, ballistic panels 10 were made that are 10"×10" with a 1-2" thickness, weighing approx. 10-13 lbs. Ballistic panel 10 can be made in varying thickness depending on the protection needed. See below for description of exemplary additional size and shape ballistic panels 10.

With continuing reference to FIG. 1A, core 12 is generally located at the center of ballistic panel 10, surrounded by ceramic layer 14. Core 12 is a three-dimensional rigid matrix designed for structural integrity and strength. In an embodiment, core 12 is an approximation of an octet truss made from plastic. Other materials for core 12 may be used. As shown, core 12 has two sides and includes opposing protrusions 22. On the opposite side of each protrusion 22 is node (or tip) 24. Each node 24 forms the end of protrusion 22 on the opposite side of core 12. The size of protrusions 22 may be varied depending on the desired thickness of ballistic panel 10 and the desired thickness of ceramic layer 14. Node 24 and protrusion 22 sizes may be chosen to accommodate different ceramic layers, as discussed below.

The embodiment of core 12 shown includes parallel, alternating rows of protrusions 22 and nodes 24 on each side of core 10, perpendicular to the X-axis in FIG. 1A. In other words, this embodiment of core 12 has, in order, a row of protrusions 22, a row of nodes 24, a row of protrusions 22, a row of nodes 24, and so on, repeating across core 12 perpendicular to the X-axis, where each row is parallel to the other rows. Protrusions 22 in each protrusion row are preferably approximately equidistant from the neighboring protrusions 22 in the same row. Likewise, nodes 24 in each node row are preferably approximately equidistant from the neighboring nodes 24 in the same row. The protrusion rows are preferably offset from one another so that where there is gap between protrusions 22 in one row, there is protrusion 22 in the next row. The node rows are preferably also similarly offset from one another so that where there is gap between nodes 24 in one row, there is node 24 in the next row. Consequently, in this embodiment, nodes 24 in each node row are aligned with protrusions 22 in one neighboring protrusion row and the gaps between protrusions 22 in the other neighboring protrusion row. As a result of this configuration, each node 24 (accept for nodes 24 on the ends of rows) is surrounded by three protrusions 22 on the same side of core 12. The triangular area around node 24 defined by the surrounding protrusions 22 (with the node 22 at the center point) is node cell 26. Node cells 26 are described in greater detail below.

Figure 1B:
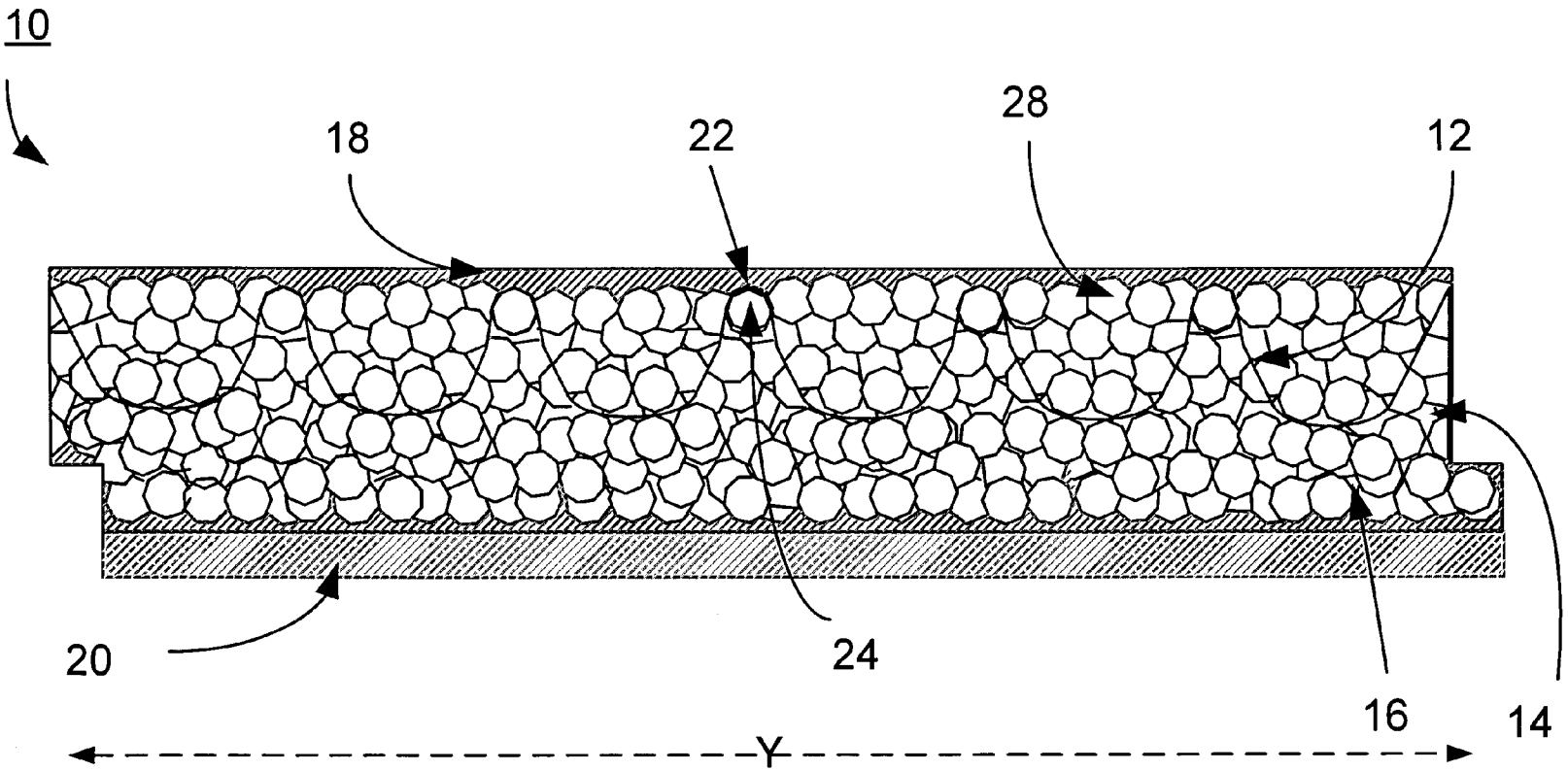

The above-described configuration with parallel rows of equidistant protrusions 22 is not readily apparent in FIG. 1A, since the cross-sectional view of ballistic panel 10 is parallel to the X-axis shown. With reference now to FIG. 1B, shown is a cross-sectional view of ballistic panel 10 that is perpendicular to the X-axis (and parallel to the Y-axis shown). Core 12 shown has been cross-sectioned down the mid-line of a row of protrusions 22 that is parallel to the Y-axis. Consequently, only protrusions 22, and the gaps between protrusions 22, on one-side of core 12 are visible in FIG. 1B.

Figure 1C:
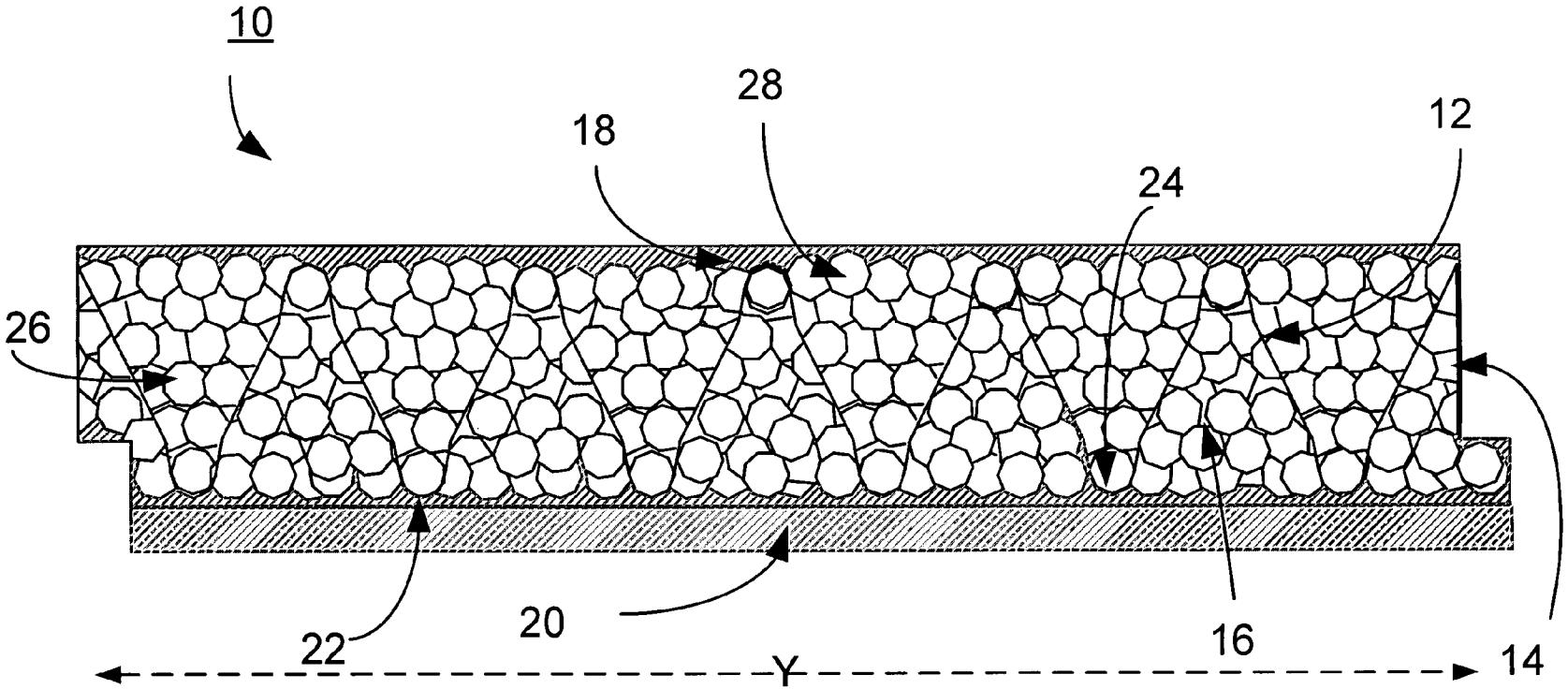

Alternative configurations of core 12 may also be used. With reference now to FIG. 1C, shown is an embodiment of ballistic panel 10 with a core 12 comprising parallel rows that include alternating, opposing, approximately equidistant protrusions 22 and nodes 24. In this embodiment, the parallel rows are preferably offset so that where one row has protrusion 22, the neighboring, surrounding rows have node 24. As a result of this configuration, each node 24 (except for nodes 24 on the ends of rows) is surrounded by four protrusions 22 on the same side of core 12. The diamond-shaped area (i.e., two triangular areas joined along their base) around node 24 defined by the surrounding protrusions 22 (with the node 22 at the center point) is also node cell 26.

With continuing reference to FIGS. 1A-1C, as shown, ceramic layer 14 surrounds core 12. In an embodiment, ceramic layer 14 fills in nodes 24 and node cells 26 on both sides of core 12. Ceramic layer 14 may completely surround core 12, filling core 12 to above protrusions 22. Alternatively, portions of protrusions 22 may be left uncovered (e.g., the ends of protrusions 22 may be uncovered). In the embodiments shown in FIGS. 1A-1C, ceramic layer 14 is equally thick on both sides of core 12. This configuration may be particularly useful for applications in which threats may come from either side of ballistic panel 10. In alternative embodiments, ceramic layer 14 is thicker on one side of core 12 (e.g., the side of ballistic panel 10, and hence core 12, facing the threat (the "threat-side")) than the other.

Figure 1D:
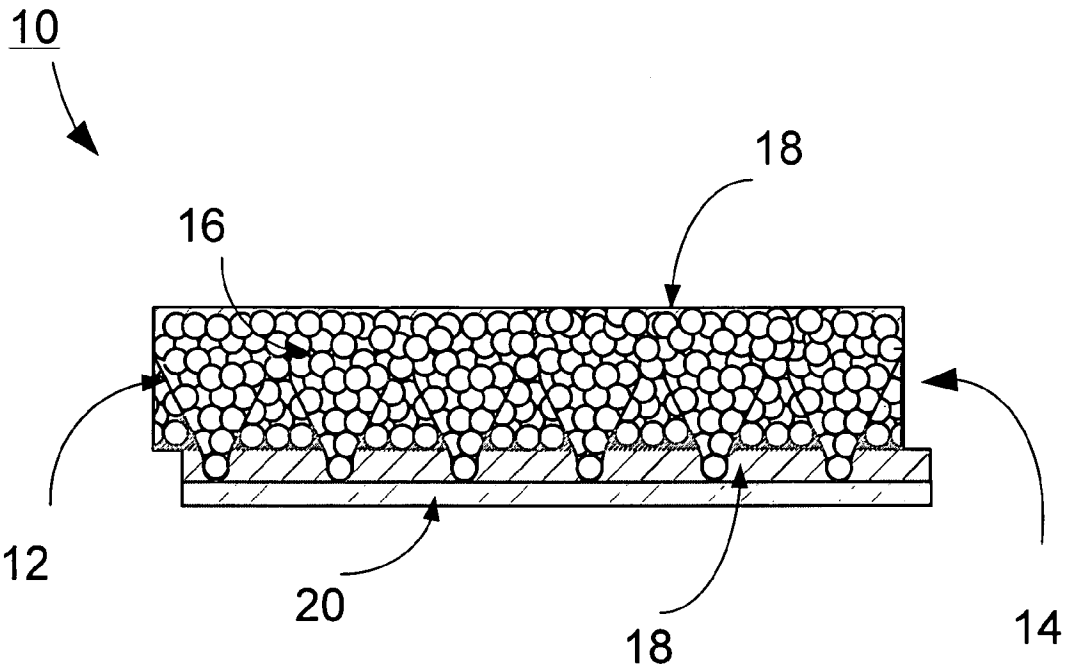

For example, FIG. 1D illustrates an embodiment of ballistic panel 10 in which ceramic layer 14 is thicker on the threat-side. A thicker ceramic layer 14 on one side of core 12 may be chosen, for example, to allow projectiles to pass through ballistic panel 10 in one direction (e.g., towards a threat) while still stopping projectiles from the opposite direction (e.g., from the threat), therefore allowing a person protected by ballistic panel 10 to shoot at the threat. This may be particularly useful when ballistic panel 10 is used in vehicle or building doors and windows, or is itself fabricated with transparent and semi-transparent material. For example, a 60-40 or 70-30 (or other ratio) ratio of ceramic layer 14 on either side of core 12 could be chosen. Similarly, a larger ratio on the "non-threat" side could also be maintained in order to enable ballistic panel 10 to intercept and absorb fragments and ricocheting projectiles on the non-threat side. For example, if ballistic panel 10 were only installed in part of a vehicle or structure, bomb fragments or projectiles could enter the vehicle or structure from another location. Ballistic panel 10, with sufficient ceramic layer 14, could intercept and absorb fragments and ricocheting projectiles within the vehicle or structure.

As shown in FIGS. 1A-1D, ceramic layer 14 may comprise ceramic spheres 28. Alternatively, ceramic layer 14 may comprise different ceramic shapes. Ceramic spheres 28 may be different sizes. Ceramic layer 14 may comprise ceramic spheres 28 all of the same size or varying sizes. In an embodiment, ceramic spheres 28 are chosen so that the diameter of ceramic spheres 28 is nearly the same as the diameter or width of nodes 24 and ceramic spheres 28 fit tightly within nodes 24. Nodes 24 may be rounded to accommodate ceramic spheres 28 or differently shaped for different ceramic shapes. Ceramic sphere 28 size may be varied depending on the ballistic projectiles that need to be stopped. If ceramic sphere 28 size is varied, node 24 and protrusion 22 size may be varied as well.

In certain embodiments, ceramic spheres 28 range in size from 0.5 to 30 mm and are typically referred to as grinding media or mill lining products. For example, 2 mm, 5 mm and 10 mm diameter ceramic spheres 28 may be used. An embodiment of ceramic spheres 28 are made primarily out of aluminum oxide with a small amount of zirconium silicate or other additives. Such ceramic spheres 28 have been used for de-agglomeration, grinding, mixing and particle size reduction for such products as minerals, floor and wall tile, porcelain enamel coatings for cookware etc. Other shapes, sizes, and materials for ceramic layer 14 may be used if they provide the same or similar performance characteristics as ceramic spheres 28. For example, Zirconium may be used or non-spherical shapes may be used.

With continuing reference to FIGS. 1A-1D, bonding media 16 bonds ceramic spheres 28 together restricting their movement. In this manner the ceramic spheres form a solid, dense ceramic layer 14. By bonding ceramic spheres 28 together and forming a high density ceramic layer 14, bonding media 16 keeps ceramic spheres 28 from being easily deflected by an incoming projectile out of the incoming projectile's path. In an embodiment, bonding media 16 is a casting urethane. Other compounds besides casting urethane may be used for bonding media 16 if the other compounds provide the same or similar performance characteristics as the casting urethane.

Outer coating 18 is designed to enclose and hold ballistic panel 10 together and provide self-healing characteristics. In an embodiment, outer coating 18 comprises a polymer layer applied to the entire, bonded ceramic layer 16. Alternatively, outer coating may only be applied to one side of ballistic panel 10. In an embodiment, outer coating 18 is an elastomeric, expandable, polyurethane, solvent free 100% solids polymer layer (e.g., a Rhinocast™ truck bed liner product). This polymer layer can be successfully sprayed on in an even layer and provides ideal results. Other materials for outer coating 18 may be used that provide the same or similar performance, such as other two component chemical processing systems that include pouring a polyurethane into a mold that becomes tack free in seconds.

After a round penetrates ballistic panel 10, the entry point is minimized based on the elastic properties of outer coating 18 polymer layer. In other words, outer coating 18 "self-heals," reducing the size of the entry point. In addition, the self-healing action hides the point of entry, which prevents an assailant from easily targeting the same hole. Outer coating 18 also helps to contain broken ceramic spheres 28 of ceramic layer 14 thereby providing multiple hit protection and enabling the broken ceramic spheres 28 to act on additional projectiles.

With continuing reference to FIGS. 1A-1D, embodiments of ballistic panel 10 are mounted on a structure, such as a door or other part of a vehicle, boat, plane or building. If the structure is made of wood, metal, concrete or other material of sufficient thickness, density and/or force-absorbing/resistant properties, ballistic panel 10 will operate as intended, substantially stopping ballistic projectiles. Embodiments of ballistic panel 10 that are not so mounted include backing 20. Backing 20 is bonded to ballistic panel 10 on the non-threat or non-impact side of ballistic panel 10. Backing 20 may be made from the same or similar materials as described above, including wood, ceramics, steel, titanium, or other metals, composites, etc. Embodiments of backing 20 are made relatively thin, e.g., 1/10 to 1/4 the thickness of ballistic panel 10, and with light-weight materials so that backing 20 does not substantially increase the weight of ballistic panel. Although backing 20 is shown on one side of ballistic panel 10, a second backing 20 may be included on the other side of ballistic panel 10. Second backing 20 would be useful for ballistic panels 10 that receive threats from both sides.

Alternative embodiments of ballistic panel 10 may replace ceramic layer 14 with some other filler (e.g., sand, fine clay, etc). Also, as sand is a ceramic media, ceramic layer 14 may simply comprise sand. Such embodiments may eliminate bonding media 16. Likewise, outer coating 18 may be not be necessary for some applications. Indeed, alternative embodiments of ballistic panel 10 may comprise only core 12 and a filler.

Figure 2A:
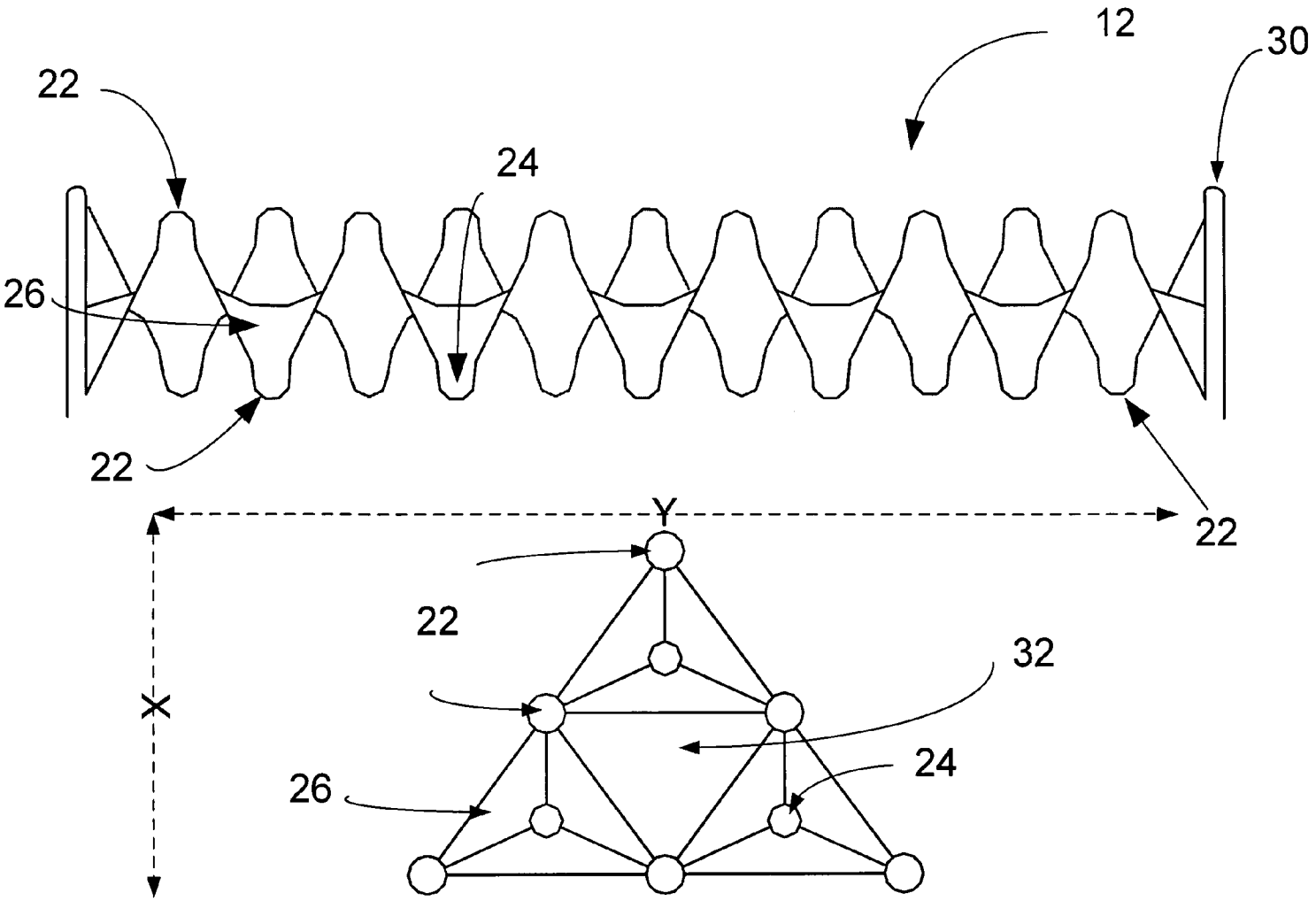

With reference now to FIG. 2A, shown is a cross-sectional view of an embodiment of core 12. As indicated in FIG. 2A, the cross-section is along the Y-axis of core 12 (see FIG. 1B above). The embodiment shown is a Tetrahedron- and Octahedron-like shape formed from a plastic sheet. The original design for the shape of core 12 is inspired by an octet truss shape from a renowned designer, Buckminster Fuller, used for structure and strength in many well-known buildings. An exemplary core 12 is seen in U.S. Pat. No. 5,266,379 issued to Schaeffer et al., which is hereby incorporated by reference (e.g., see element 14 in FIGS. 2 and 3 of Schaeffer et al.). Core 12 shown in FIG. 2A approximates the octet truss shape. Consequently, core 12 filled with ceramic layer 14 (e.g., bonded ceramic spheres 28) is able to withstand high foot pound pressure provided by explosions. As is discussed herein, core 12 also acts to absorb, translate and dissipate the force from a ballistic projectile impacting on ballistic panel 10. Some of the force of the ballistic projectile may be transferred from the projectile to ceramic layer 14 to core 12 and translated from the direction of impact outwards in node cell 26 of impact and along the alternating protrusions 22 and nodes 24 of core 12. For example, if the direction of impact generally is along the Z-axis perpendicular to ballistic panel 10, in a three-dimensional grid of X-Y-Z, some of the force may be translated in the plane formed by core 12 along the X- and Y-axes. This translated force may be dissipated into ceramic layer 14 on the non-impact side of core 12 and into the material on which ballistic panel 10 is mounted or into backing 20. Other shapes and materials for core 12 may be used if they provide the same or similar performance characteristics as core 12 illustrated here. For example, core may be made out of ceramics, titanium or other metals, composite materials, etc.

With continued reference to FIG. 2A, core 12 includes parallel rows of protrusions 22 and nodes 24. In the embodiment illustrated here, each row of protrusions 22 is offset from the next row of protrusions 22 so that where there is protrusion 22 in one row there is a gap between protrusions 22 in the next row. The rows of nodes 24 are similarly offset. The shape and size of nodes 24 may match ceramic spheres 28 (or other shape) used in ceramic layer 14.

Embodiments of core 12 may also include casting walls 30 around the outside of core 12. Casting walls 30 allow core 12 to contain ceramic layer 14 (e.g., ceramic spheres 28) and bonding media 16 (e.g., casting urethane) during casting of ceramic layer 14. In this manner, core 12 provides a self-contained casting unit for ballistic panel 10. As shown in FIG. 2A, casting walls 30 extend beyond the ends of protrusions 22 on both sides of core 12. Consequently, casting walls 30 enable the fabrication of ceramic layer 14 on both sides of ballistic panel 10.

Casting walls 30 may define the shape of ballistic panel 10. For example, if a square ballistic panel 10 is desired, casting walls 30 will be fabricated so as to form a square. If a triangular or circular ballistic panel 10 is desired, casting walls 30 will be fabricated to form triangle or circle. Casting walls 30 may be fabricated in any manner of two-dimensional shape desired (e.g., square, circle, triangle, rectangle, parallelogram, diamond, irregular shapes, non-symmetrical shapes, etc.). Consequently, ballistic panel 10 can be almost any manner of two-dimensional shape.

With continued reference to FIG. 2A, also shown is two-dimensional diagram providing a geometric representation of the spatial and geometric relationship between protrusions 22 and nodes 24 seen from one side of an the embodiment of core 12 shown. As discussed above, in an embodiment of core 12, each node 24 is surrounded by three protrusions 22 when viewed from one side of core 12. In an embodiment, the three surrounding protrusions 22 form an equilateral triangle with the surrounded node 24 at the center point of the triangle (the lines connecting the surrounded node 24 with the each of the surrounding protrusions 22 in the diagram are equal in length). Therefore, the surrounded node 24 is equidistant from each surrounding protrusion. The triangle formed by the surrounding protrusions 22 also forms the area referred to above as node cell 26. As shown, the diagram in FIG. 2A only represents a portion of protrusions 22 and nodes 24 in core 12. Specifically, the diagram illustrates three triangles formed by protrusions 22 surrounding three nodes 24 in neighboring rows of nodes 24 and protrusions 22. Protrusions 22 at the "top" of the lower two triangles are the "base" protrusions 22 in the "top" triangle. Consequently, the three triangles themselves form one larger, equilateral triangle. The area between these two protrusions 22 and the "bottom" middle protrusion 22 of the larger triangle is also an equilateral triangle, inverted with respect to the other triangles. The area formed by this inverted triangle is node-less cell 32, since it does not include node 24. Ceramic layer 14 (e.g., ceramic spheres 28) will also fill this node-less cell 32. So filled, node-less cells 32 in core 12 will also act in stopping projectiles and translating force of projectiles impacting within each node-less cells 32.

Figure 2B:
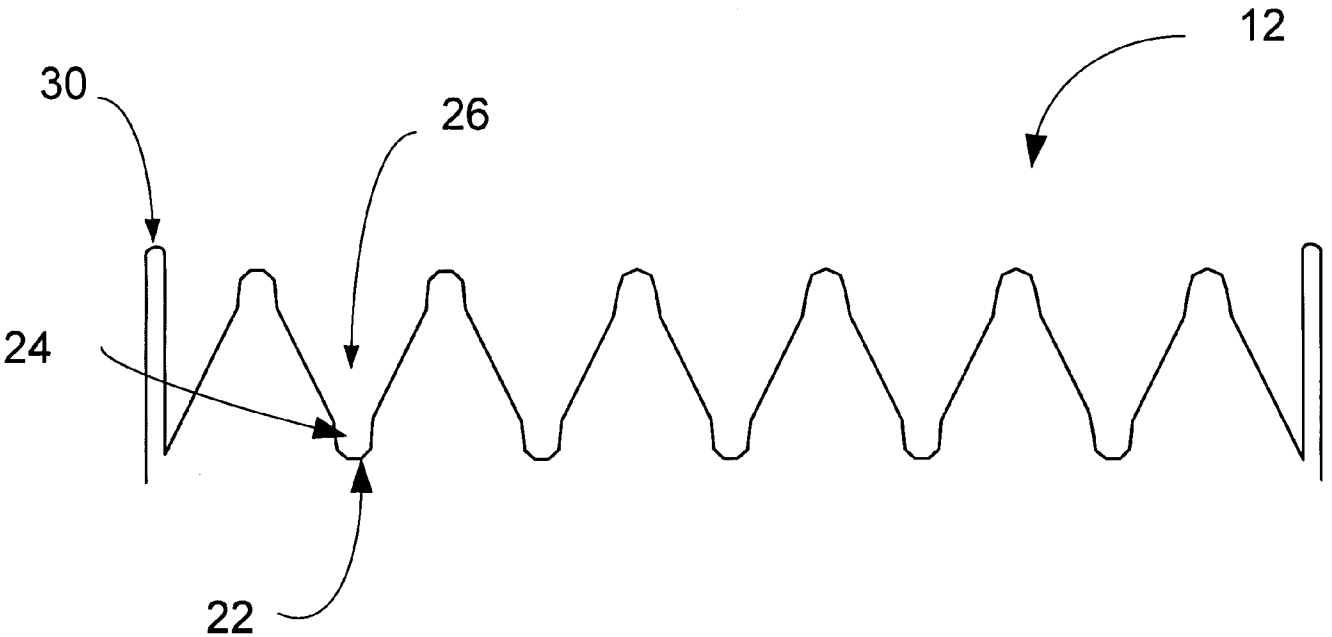

FIG. 2B illustrates a cross-sectional view of an embodiment of core 12 with opposing, alternating protrusions 22 and nodes 24. Core 12 shown here also includes casting walls 30, which are discussed above.

Figure 2C:
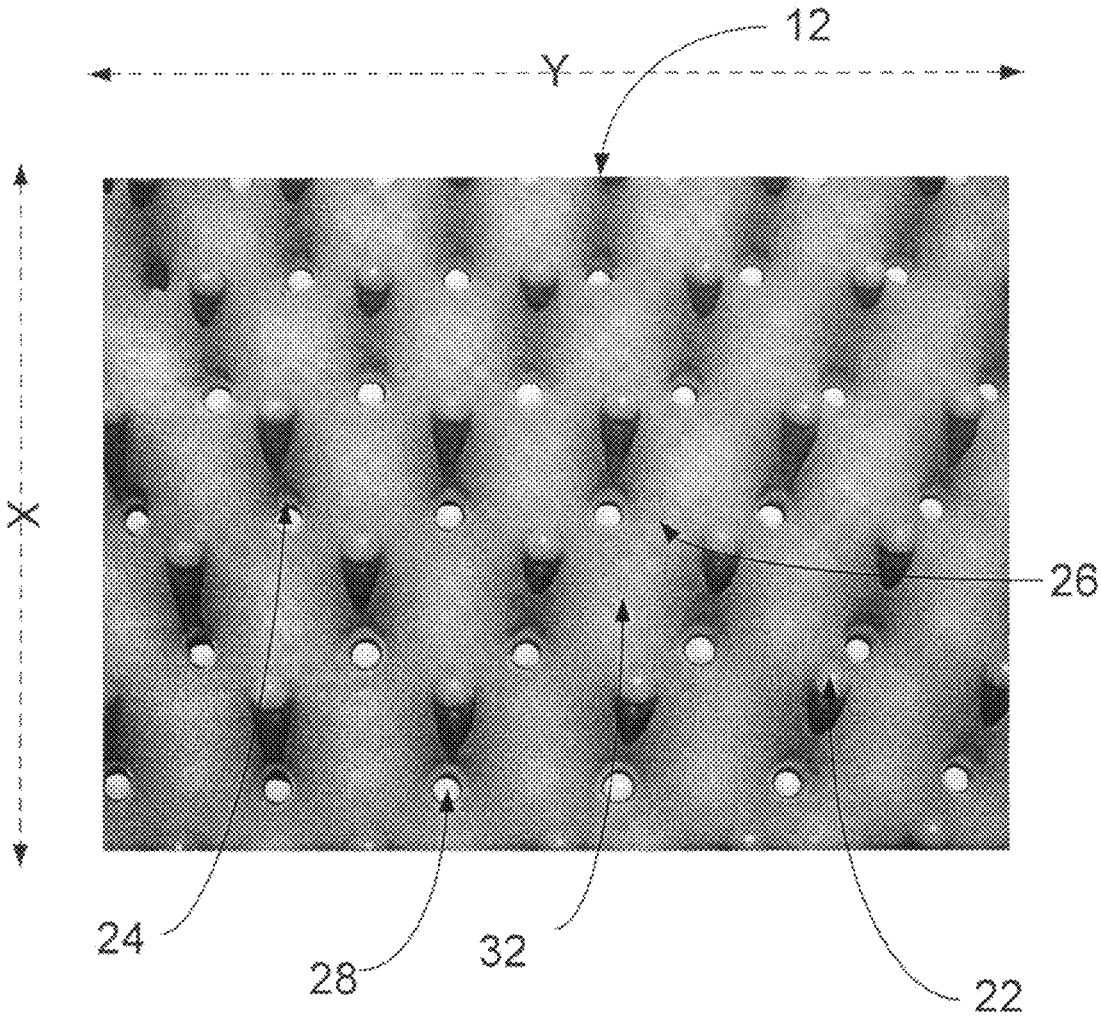

With reference now to FIG. 2C, shown is a partial top view of an embodiment of core 12. The embodiment of core 12 shown in FIG. 2C is substantially the same as the embodiment illustrated by FIG. 2A. As seen, the embodiment includes parallel, offset rows of protrusions 22 and nodes 24, with each node 24 surrounded by three protrusions 22 that create node cell 26, as discussed above. Core 12 also include node-less cells 32. In the view shown in FIG. 2C, ceramic spheres 28 have been placed into nodes 24, illustrating the matching size of ceramic spheres 28 and nodes 24. The X-axis and Y-axis indicate the orientation of the view with respect to same X-axis and Y-axis described above.

Figure 2D:
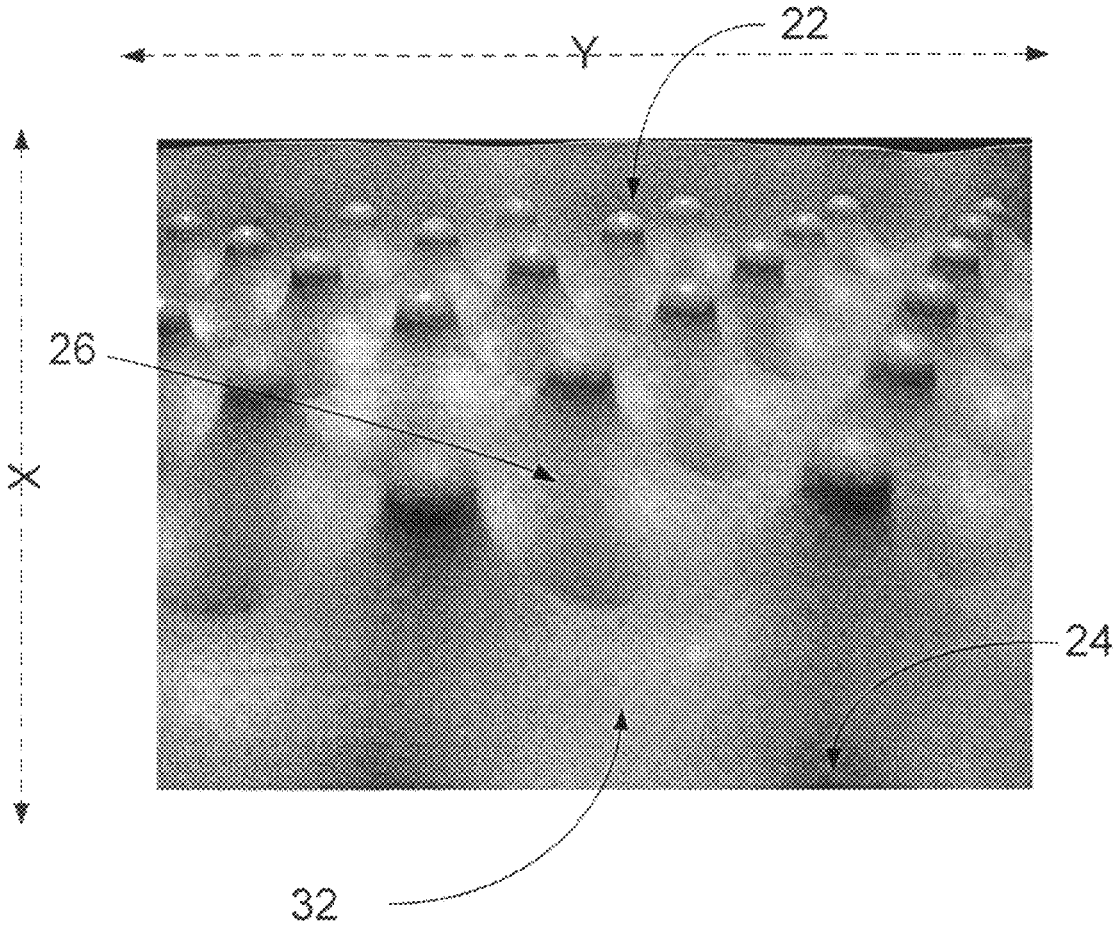

With reference now to FIG. 2D, shown is a partial top perspective view of an embodiment of core 12. The embodiment of core 12 shown in FIG. 2D is substantially the same as the embodiment illustrated by FIGS. 2A and 2C. As shown, core 12 includes protrusions 22, nodes 24, node cells 26, and node-less cells 32. Protrusions 22 and nodes 24 are configured in parallel, offset rows, as discussed above. The X-axis and Y-axis indicate the orientation of the view with respect to same X-axis and Y-axis described above.

It is important to note that core 12, e.g., as illustrated in FIGS. 1A-2D may be utilized without ceramic layer 14 and outer layer 18. Different media, such as sand, soil, water, etc., may be combined with core 12 in a variety of protective and structural applications. See below for further description of such applications.

While the concept behind most traditional armor is to laminate fibers and use steel or ceramic plates to slow down or deflect high velocity rounds, embodiments of ballistic panel 10 use a dual approach of first reducing the mass of the round by a chain reaction of ceramic spheres 28 within node cell 26 and then absorbing and translating the resulting shock with core 12.

This unique combination of materials and layers in ballistic panel 10 appears to work through a grinding action that grinds down the projectile, and the translation of the force of the projectile into multiple directions, creating a destructive circumstance. The ceramic layer 14 performs the grinding action, breaking apart the projectile and translating some of the force of the projectile into multiple directions. The grinding action appears to grind away the outer jacket of a round, exposing the lead within. The round is subjected to high friction and other forces and resulting high temperatures that turn lead into molten. Some of ceramic spheres 28 may break apart during impact and grinding of the projectile.

Core 12 may absorb and translate some of the force of the projectile and may contain the affects of the projectile's impact within node cell 26 (or node-less cell 32) of ceramic spheres defined by core 12. As discussed above, core 12 may transfer some of the force of the projectile to backing 20 and/or to the material on which ballistic panel 10 is mounted. Outer coating 18 seals ballistic panel 10 so that ceramic particles do not leak out. Outer coating 18 provide self-healing characteristics so that ballistic panel 10 that has been hit previously still provides superior protection. The giving, yet self-healing characteristics of outer coating 18 may also help prevent deflection of the projectile out of ballistic panel 10.

Embodiments of ballistic panel 10 may be used as a portable fighting wall, a ballistic shield for vehicles or aircrafts, perimeter guard post or when setting up a temporary base camp. Multiple layers of core 12 may be added for different threat levels. Likewise, multiple ballistic panels 10 may be stacked to increase protection. Furthermore, additional protective materials, such as steel or ceramic plate, may be combined with ballistic panels 10.

Ballistic panel 10 is ideal for vehicle protection, and can be easily attached to doors, passenger and driver compartments, cabs, roofs, etc., to provide protection. Ballistic panel 10 may be manufactured and molded in a variety of shapes, enabling it to be used, e.g., as flooring, walls, doors, vehicle seats, cargo area panels building blocks or bricks. Consequently, ballistic panel 10 may be molded in the shape of a vehicle (e.g., HMMV, truck, FMTV, etc.) door and be used to replace standard doors on the vehicle, providing greatly increased protection without significant added weight or cost. Likewise, ballistic panel 10 may be molded in the shape of vehicle seats, replacing standard vehicle seats and providing greatly increased protection without significant added weight or cost. Furthermore, ballistic panel 10 building blocks or bricks may be used to create armored buildings, bunkers, and structures that would be significantly more resistant to explosions (e.g., from suicide bombers), ballistic rounds, mortars, etc. Ballistic panel 10 may be manufactured as interlocking panels that can be joined together to form a seamless wall of protection. Other applications include security check points, modular walls and doors built from ballistic panel building blocks to secure sensitive areas in airports, nuclear facilities, fuel depots, government facilities, etc. First response vehicles, police vehicles, HAZMAT vehicles, and mobile command centers could be protected by ballistic panels 10.

Multiple ballistic panels 10 may be combined to form specific use structures. For example, ballistic panels 10 could be combined to form a "bomb-box" which is used to contain the blast from a suspected or known explosive device. The bomb-box would be a box (e.g., a hollow cube) formed by ballistic panels 10. The walls of the bomb box may be formed by ballistic panels 10. A bomb squad could drop the bomb-box on the explosive device and then wait for the explosive device to go off or trigger the explosive device, containing the explosion within the bomb-box. The bomb-box could include devices (straps, bolts, anchors, etc.) for securing the bomb-box to the ground.

It should also be noted that embodiments of ballistic panel 10 has sound-absorbing properties. The combination of materials, layers and structure in embodiments of ballistic panel act also to absorb sound. This is particularly useful to reduce the "clang" or "ringing" effect of explosions and projectiles, particularly within enclosed areas such as vehicles. These sonic effects can be very disorienting to soldiers, and therefore, are themselves battlefield hazards ballistic panel 10 can help to reduce.

Figure 3:
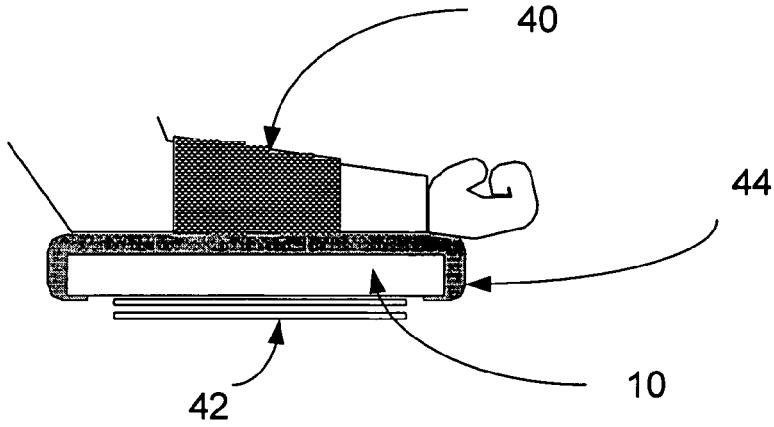

With reference now to FIG. 3, shown is yet another implementation of ballistic panel 10. Ballistic panel 10 may include one or more straps or strapping 40 that enables a user to strap ballistic panel 10 to the user's arm, torso, leg, etc. In this manner, ballistic panel 10 may be used as a personnel shield. The embodiment of ballistic panel 10 shown here is intended for use as a seat, e.g., in a vehicle or airplane. Ballistic panel 10 seat may be attached to a seat frame with Velcro or some other attaching mechanism 42, as indicated in FIG. 3. The Velcro attachment 42 enables the user to easily and quickly remove ballistic panel 10 seat in order to use it as a personnel shield. This enables the user, e.g., to escape from a disabled vehicle with some amount of protection. Ballistic panel 10 seat also may include padding or padded cover 44 to increase comfort and usability as a seat.

Figure 4A:
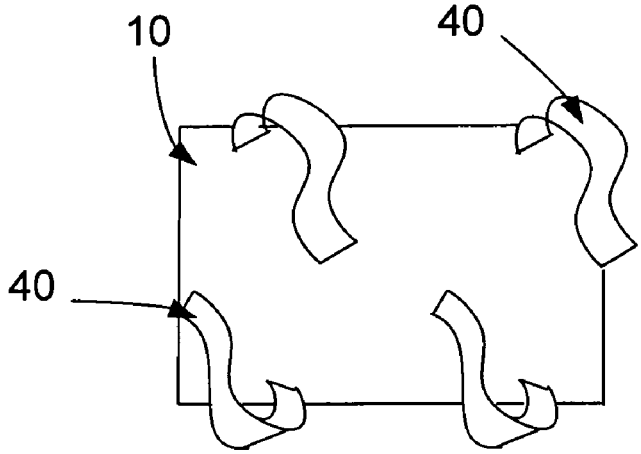
Figure 4B:
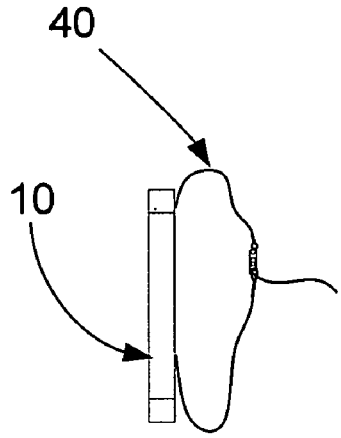

With reference now to FIGS. 4A-4B, shown is another implementation of ballistic panel 10. As discussed above, ballistic panel 10 may include one or more straps or strapping 40 that enables a user to strap ballistic panel 10 to the user's arm, torso, leg, etc. Strapping 40 may also be utilized to attached ballistic panel 10 to other things as well, such as vehicle parts, building parts, etc. FIG. 4A depicts a rear view of ballistic panel 10 showing two sets of un-connected straps 40. FIG. 4B depicts a side view showing one set of connected straps 40. Straps 40 may be connected in any known manner, including buckles, snaps, cinches, etc.

Figure 5A:
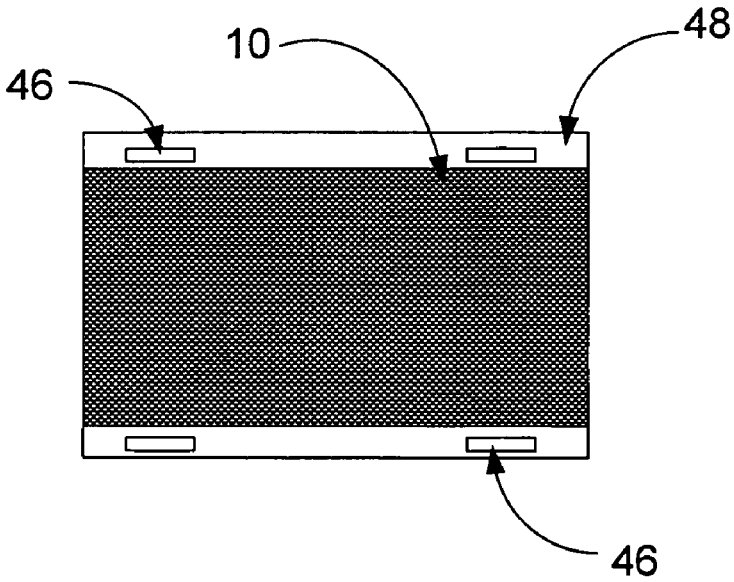
Figure 5B:
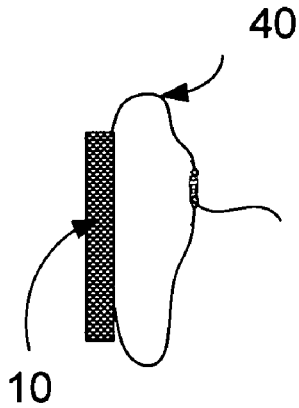

With reference now to FIGS. 5A-5B, shown is another implementation of ballistic panel 10 with strapping 40. In the implementation shown here, ballistic panel 10 includes slots 46 for affixing strapping 40 to ballistic panel 10. For example, slots 46 may be formed in ballistic panel 10 or ballistic panel 10 may be formed with extensions 48, e.g., strips of material (e.g., metal) extending from the sides of ballistic panel 10, with slots 46 formed in the extensions 48. FIG. 5A depicts a top view of ballistic panel 10 with extensions 48 and slots 46. FIG. 5B depicts a side view showing one set of connected straps 40 that are affixed to ballistic panel 10 through slots 46.

Figure 6:
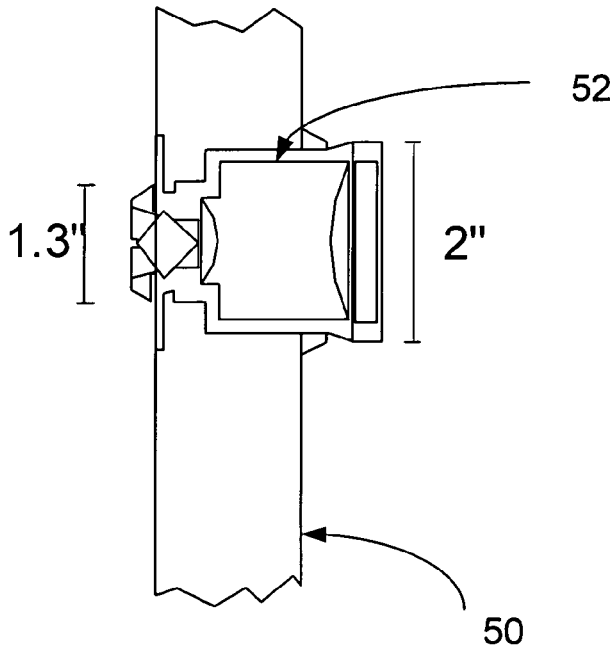

As discussed above, ballistic panel 10 may be used as a door or door panel. Similarly, ballistic panel 10 may be used as a wall or portion of wall. Often it will be necessary or desirous to be able to have some ability to see through a door or wall formed with ballistic panels 10. With reference now to FIG. 6, shown door panel 50 formed with ballistic panel 10. Formed within door panel 50 is viewer 52 that enables a user to look through door panel 50, e.g., to identify threats on the other side of door panel 50. In the embodiment shown, viewer 52 provides viewing up to 7' away with a 132 degree viewing angle. Viewer 52 is preferably made from material capable of withstanding impacts from projectiles and explosions. As shown, the viewer also preferably only presents a minimal area to the exterior of the door panel. In FIG. 6, this area is only ⅓" in diameter. The reciprocal eye piece shown is 2" in diameter. Viewers with different specifications may be used.

Ballistic panel 10 may also be manufactured from clear and/or semi-clear materials, such as clear plastic, ceramics and polymers, that enable light to pass through ballistic panel 10. Such a construction may enable ballistic panel 10 to be used as windows or for providing natural light sources. This construction would enable, e.g., buildings constructed from ballistic panel 10 building blocks to have protected windows made from ballistic panel 10. Likewise, clear ballistic panels 10 may be combined with opaque ballistic panels 10 to form an entire wall with a window from ballistic panels 10.

Embodiments of ballistic panel 10 are remarkably successful in stopping high-velocity rounds. Testing has shown embodiments of ballistic panel 10 capable of stopping high-velocity full metal jacket rounds as well as armor-piercing rounds. So not only does ballistic panel 10 work extremely well in testing but it remains relatively lightweight, easy to assemble and the cost is well below anything else on the market.

Ballistic panel 10 can stop high velocity and withstand lower velocity fragmentation, shrapnel, and related explosive force, like in a case of RPG (Rocket Propel Grenade) low velocity high fragment. For blunt force impacts, core 12 appears to help dissipate the load. By allowing ceramic layer 14 (e.g., ceramic spheres 28) to move independently within nodes 24 defined by core 12, core 12 helps to minimize damage to ballistic panel 10. Consequently, ballistic panel 10 can withstand multiple strikes in a small area.

Observation shows that embodiments of ballistic panel 10 appear to work in the following manner. A high-velocity round enters outer layer 18. Outer layer 18 absorbs some of the force of the round and applies some friction to the round, which helps to heat it up and slow it down. The elastic nature of outer layer 18 allows it to "self-heal" so that the hole left by the entry of the round is much smaller than the diameter of the round. This increases the durability and re-usability of ballistic panel 10.

After passing through outer layer 18, the round encounters bonded ceramic layer 14 (e.g., ceramic spheres 28). Bonded ceramic layer 14 absorbs and translates even more of the force of the round. In embodiments comprising ceramic spheres 28, which are often used for grinding and de-agglomeration, ceramic spheres 28 appear to grind the round. This grinding may grind off the outer layer or jacket (e.g., the full-metal jacket) of the round, creating great friction and resulting heat and exposing the inner portion (e.g., lead) of the round. The grinding appears to break up the round. The friction and heat appear to act to further slow down the round, disintegrating and possibly melting the round, particularly the generally softer inner portion. Melting the inner portion may cause the round to dissipate some, reducing its effective mass and enabling ceramic layer 14 and core 12 to further absorb the round's force, slow the round down, and eventually stop the round. The grinding and/or melting of the round may result in multiple pieces of the round, which are then re-directed upon impact with ceramic spheres 28. After being struck by a round, many of ceramic spheres 28 are broken, often crushed into a powder. Bonding media 16 helps to contain the broken and affected ceramic spheres 28, enabling broken ceramic spheres 28 to still be affective in stopping additional rounds and impacts and maintaining the integrity of ballistic panel 10.

Core 12 of ballistic panel 10 acts as a further force absorber and translator. Core 12 appears to act to help contain the force and effects of the penetrating round within an affected node cell 26 (or node-less cell 32) defined by a set of protrusions 22 of the Tetrahedron- and Octahedron-shape (e.g., the octet truss shape). When a round strikes ballistic panel 10, core 12 appears to help contain its affects to bonded ceramic spheres 28 in the area of node cell 26 (or node-less cell 32) struck by the round. Further, core 12 itself also appears to absorb at least some of the remaining, dissipated force of the round. Whatever remaining force of the round that makes it through core 12, if any, appears to be absorbed by bonded ceramic spheres 28 on the opposite side of core 12 and by backing 20 or the material on which ballistic panel 10 is mounted in much the same manner as described above.

As mentioned above, core 12 of ballistic panel 10 appears to play a significant role in absorbing and translating the force of lower velocity, fragmentary, shrapnel and explosive impacts, such as RPGs and roadside bombs. The size of ceramic spheres 28 appears to be directly related to the caliber of the round capable of being stopped by ballistic panel 10. In an embodiment of ballistic panel 10, the size and shape of core 12 of ballistic panel 10, particularly nodes 24 of core 12, are chosen so that ceramic spheres 28 fit tightly and well within nodes 24 of core 12—see, e.g., FIG. 2C. An embodiment of ballistic panel 10 may combine ceramic spheres 28 of varying sizes to enable ballistic panel 10 to effectively stop a variety of caliber rounds and projectiles of varying size and mass.

The following are exemplary results from the testing of an embodiment of ballistic panel 10. A test was performed using Armor Piercing Rounds. All rounds were fired at 10 yards from the target.

| Shot # | Ammo. | Velocity Ft/Sec | Range Yards | Penetration |
|---|---|---|---|---|
| 10 | 5.56 FMJ | 3240+/− | 10 | N |
| 10 | 7.62 FMJ | 2365+/− | 10 | N |
| 3 | 308 FMJ | 2700+/− | 10 | N |
| 3 | 30-06 | 2925+/− | 10 | N |
| 3 | 30-06 AP | 2850+/− | 10 | N |

Product: Ballistic Panel 2 in, 5 mm ceramic spheres
Test Firearm: AR-15 5.56 mm, AK-47 7.62 mm, 308 150 gr, 30-06 166 gr FMJ, 30-06 AP.
Results: Ballistic Panel stopped all 29 rounds.

Tests of an embodiment of ballistic panel 10 show that it exceeds the National Institute of Justice Ballistic Standards (NIJ) level III threat rating and the Underwriters Laboratory UL 752 Ballistic Standards UL level VIII. Most national testing laboratory require only five rounds spaced 4 to 4.5 inches apart. An embodiment of ballistic panel 10 stopped all 29 rounds, some just a few millimeters from the other.

Test results on a 2.2" embodiment of ballistic panel 10 are shown below:

| Sample/Test Description | | | Ammunition Description | | | Chronograph | | Results |
|---|---|---|---|---|---|---|---|---|
| Sample No. | Sample Thickness | Sample Weight (lbs) | Shot No. | Caliber | Bullet Wt./Type | Time | Velocity fps | Penetration No Penetration |
| 1 | 2.20" | 20.76 | 1 | 7.62 mm | 148 M80 | 206.2 | 2778 | No Penetration |
| 1 | 2.20" | 20.76 | 2 | 7.62 mm | 148 M80 | 206.0 | 2781 | No Penetration |
| 1 | 2.20" | 20.76 | 3 | 7.62 mm | 148 M80 | 207.5 | 2760 | No Penetration |
| 1 | 2.20" | 20.76 | 4 | 7.62 mm | 148 M80 | 204.8 | 2797 | No Penetration |
| 1 | 2.20" | 20.76 | 5 | 7.62 mm | 148 M80 | 204.7 | 2798 | No Penetration |

Issues and some of the variables that can be modified for different applications:

- Self-healing outer layer 18—e.g., of any material with those characteristics
- Ceramic Spheres 28—e.g., of any material providing the similar characteristics for the application. E.g.: Zirconium is denser but may be better for heavy armored applications. Note: These could be Buckey-balls or other geometries.
- Bonding material 16—e.g., of any material with the same characteristics
- Core 12—e.g., of any material providing the same characteristics as the plastic
- Shape—e.g., of any that fits the application and has the same dynamic and static characteristics
- Thickness—e.g., thin, medium, thick
- Density for different applications—e.g., Light, medium, heavy
- Proportional thickness of each layer—e.g., relative thickness of core 12, ceramic layer 14, and outer layer 18, and relative thickness of ceramic layer 14 on "threat" and "non-threat" side of core 12.

Figure 7:
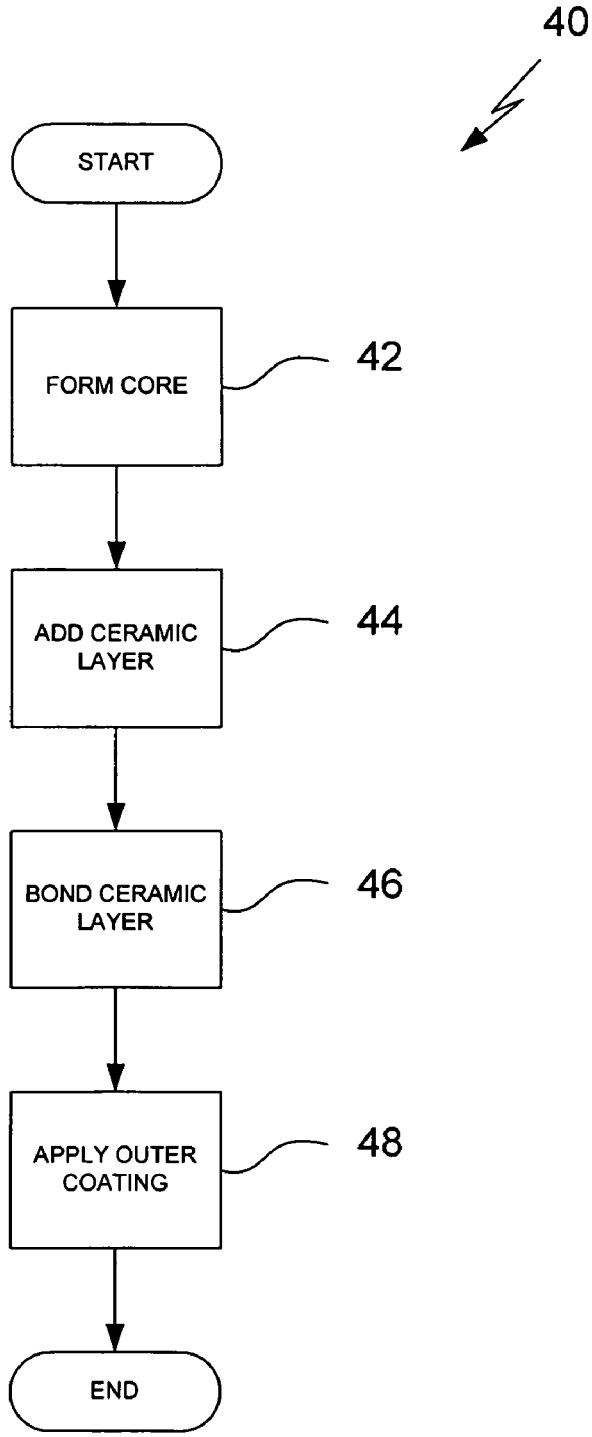

With reference now to FIG. 7, shown is an embodiment of method 40 of making a ballistic panel. Embodiments of method 40 involve a fine balance of the all materials used, orientation of materials and the proper reaction timing. As shown, method 40 includes forming a core 12, block 42, adding ceramic layer 14, block 44, bonding ceramic layer 14, block 46, and applying outer coating 18, block 48.

Figure 8:
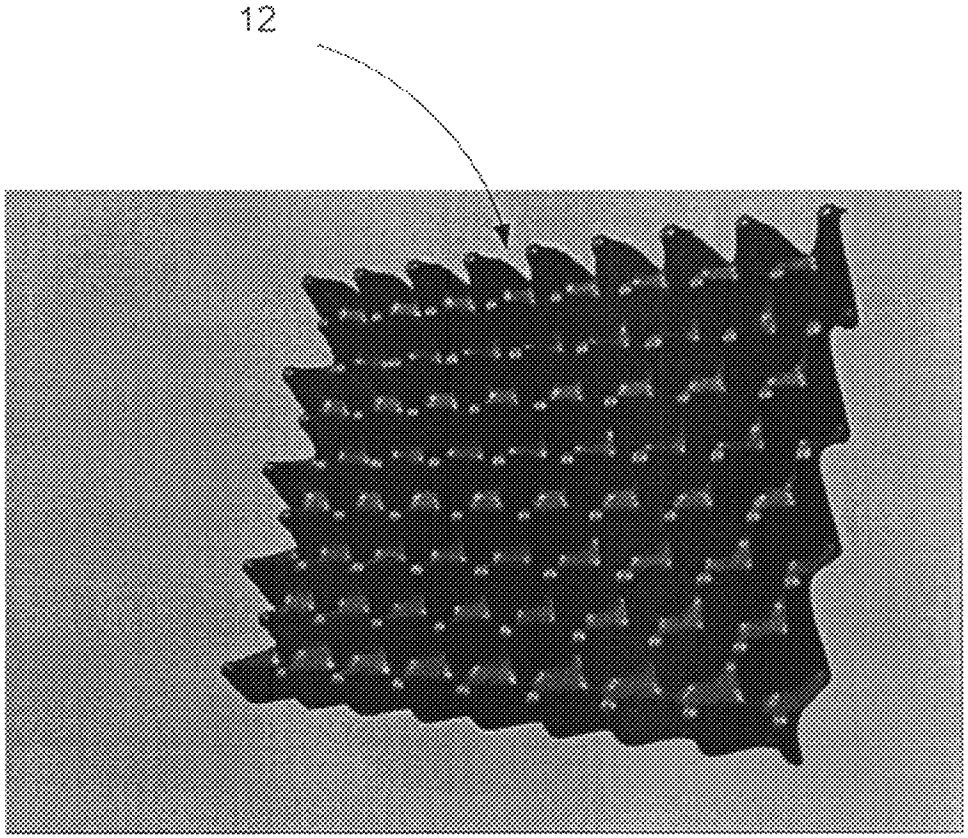

Core 12 may be formed 42, for example, from a plastic sheet using known processes. For example, core 12 may be formed using mechanical thermoforming. For example, polycarbonate may be heated and then pressed between two plywood forms with pegs (other structures) placed, sized and shaped on the plywood form in order to form protrusions 22 on each side of core 12. The plywood forms may also include structures that form bonding walls 30. Other material for the forms may be used. Likewise, other material for core 12 may be used. Core 12 may also be formed by pouring core material into a pre-formed mold. Other processes for forming 42 core 12 processes such as injection molding, reaction injection molding, rotational molding, blow molding, vacuum forming, twin sheet forming, and stamping. Core 12 may be formed in whatever shape is desired for end application of ballistic panel 10. Numerous examples of such applications are provided herein. With reference now to FIG. 8, shown is a perspective view of an exemplary core 12 formed according to forming 42.

Figure 9:
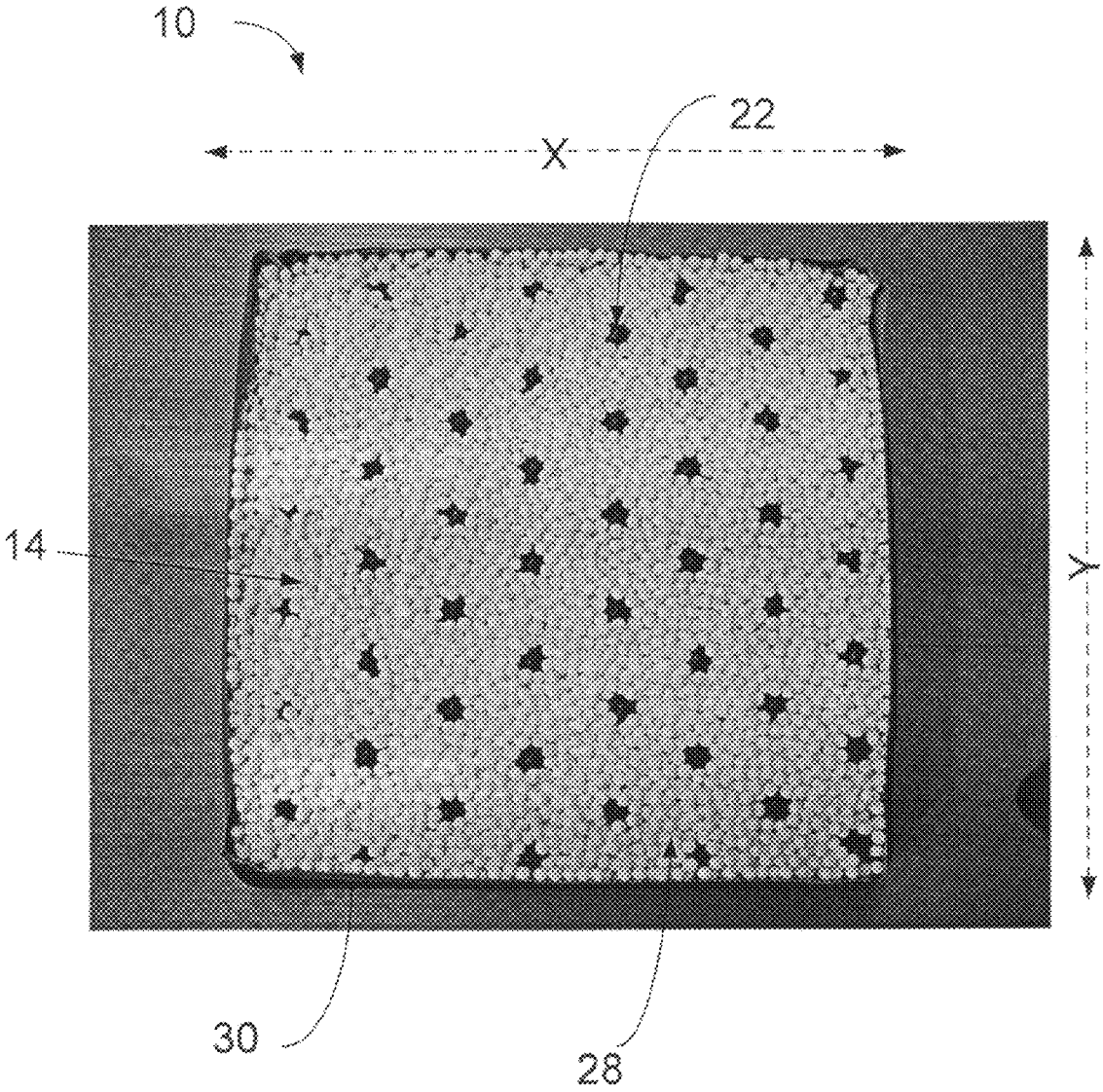

Adding 44 ceramic layer 14 may include, for example, filing core 12 on both sides with ceramic spheres 28 so that ceramic spheres 28 fill in nodes 24, node cells 26, and node-less cells 32 in core 12. This may be done, for example, by pouring ceramic spheres 28 into and onto one side of core 12, applying a press or some other mechanism for keeping the poured ceramic spheres 28 in place, flipping core 12 over and repeating the process for the other side of core 12. In an embodiment, ceramic layer 14 snugly fills core 12 and covers all but the ends or tops of protrusions 22 on either side of core 12. With reference now to FIG. 9, shown is an embodiment of core 12 filled with ceramic layer 14 as a result of the adding 44. Other processes for adding ceramic layer 14 that achieve the same or similar results may be used.

Figure 10:
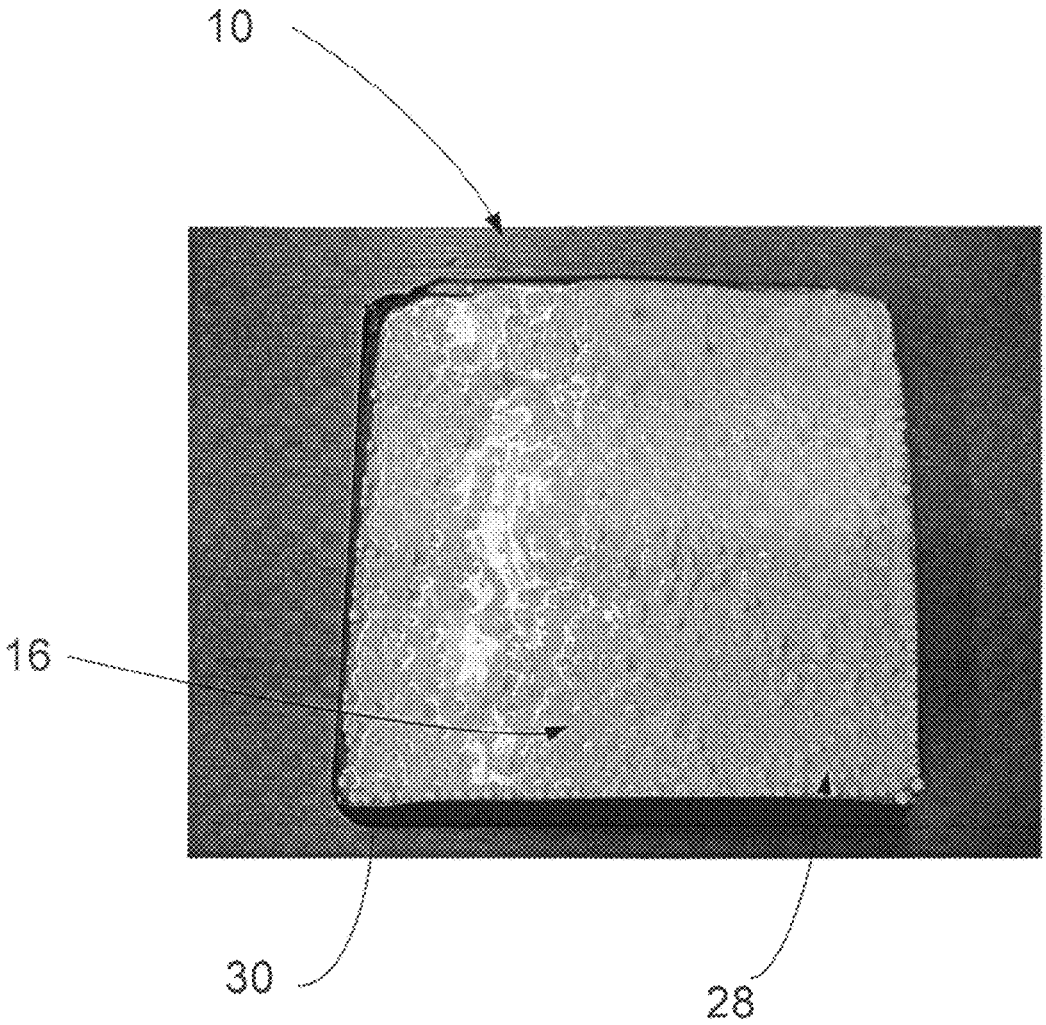

Bonding 46 ceramic layer 14 may include applying bonding media 16 to ceramic layer 14. This may be done, for example, by pouring a casting urethane into ceramic layer 14. Typical casting urethanes cure at room temperature, although heat may be introduced to speed up the curing process. The casting, bonding or encapsulated material that may be used for bonding media 16 provides a wide variety of hardness and performance. For example, PolyTeK EasyFlo™ 120 may be used. With reference now to FIG. 10, shown is an embodiment of ceramic layer 14 being bonded with a bonding media 16 during bonding 46.

Applying 48 outer coating 18 may include applying a self-healing polymer onto the bonded ceramic layer 14. For example, outer coating 18 may be sprayed, dipped or cast. For example, in an embodiment, a truck bed liner (e.g., Rhinocast™) is sprayed on. Likewise, in an embodiment, outer coating 18 is applied 48 using two component chemical processing system that includes pouring a polyurethane into a mold that becomes tack free in seconds. With reference now to FIG. 11, shown is an embodiment of ballistic panel 10 coated with a clear outer coating 18. With reference now to FIGS. 12A-12B, shown is an embodiment of ballistic panel 10 being coated with opaque outer coating 18. Backing 20 attached to ballistic panel 10 may be seen in FIG. 12A. FIG. 12B illustrates completed ballistic panel 10.

Method 40 of making ballistic panel 10 may also include attaching backing 20. Backing 20 may be attached to ballistic panel 10 using known means. For example, backing 20 may be attached to ballistic panel 10 with adhesives, straps, bolts or other attaching devices. The straps, bolts or other attaching devices may be bonded to ballistic panel 10 as part of bonding 46 and/or applying 48. For example, ends of bolts could be inserted into ceramic layer 16 and bonding media 16 may be poured into ceramic layer 16, bonding the bolt ends to ceramic layer 16. Outer coating 18 may then be applied 48 around and/or onto the protruding bolts.

FIGS. 8-12B graphically illustrate an embodiment of method 40 of making ballistic panel 10. As noted above, shown in FIG. 8 is an exemplary core 12. Core 12 may be formed 42 as described above. As discussed above and shown in FIG. 8, core includes protrusions 22 and cavities between protrusions 22, referred to as nodes 24. A ceramic layer 14 is then added 44, as shown in FIG. 9. In the embodiment shown, ceramic layer 14 is ceramic spheres 28. Ceramic spheres 28 fill in nodes 24, node cells 26 and node-less cells 32 (if any) in core 12, as shown, at least until only the ends of protrusions 22 are uncovered.

After ceramic layer 14 is added, ceramic layer 14 is bonded 46 (e.g., a bonding media 16 is applied), as illustrated in FIG. 10. As discussed above, bonding media 16 may be a casting urethane. The casting urethane bonds ceramic spheres 28 to each other to restrict movement and provide high density. In the embodiment shown in FIG. 10 bonding media 16 is applied so that it completely covers ceramic layer 14 and protrusions 22.

After bonding media 16 is applied, backing 20 may be bonded to the partially constructed ballistic panel 10, as illustrated in FIG. 12A. Backing 20 may be made from a variety of materials, including steel or other metals, wood, composite materials or ceramics. Backing 20 may be used to provide mounting or attaching mechanisms to ballistic panel 10, e.g., such as the strapping embodiments discussed above with reference to FIGS. 3-5. Backing 20 also provides additional force-absorbing properties when ballistic panel 10 is free-standing or not mounted on a material with sufficient force-absorbing properties.

Outer coating 18 is then applied 48 to ballistic panel 10, as illustrated in FIGS. 12A-12B. As discussed above, outer coating 18 may be a polymer layer. Outer coating 18 is designed to hold ballistic panel 10 together and provide self-healing characteristics. Outer coating 18 may cover the entire ballistic panel 10, as seen in FIG. 12B, or only a portion of ballistic panel 10 (e.g., just the front side). If a backing 20 is added, as shown in FIG. 12A, outer coating 18 may cover it as well.

Physics and observation may be used to explain how ballistic panel 10 works. Through calculating the momentum (energy=mass×velocity$^2$÷the coefficient) of different caliber bullets and physical testing, it was discovered that at the same distance two bullets with the same momentum penetrate differently. The bullet with smaller mass and higher velocity always penetrated further then a bullet with lower velocity and greater mass. Consequently, affecting the velocity of the bullet appeared to be important.

Through analysis, it was determined that a mass that acted more like a dense fluid would be more effective than layering materials on top of one another and new constructions were made and tried.

Isaac Newton's first law of motion is often stated "An object at rest tends to stay at rest and an object in motion tends to stay in motion with the same speed and in the same direction unless acted upon by an unbalanced force." This means if the direction of an object in motion is changed, the speed of the object may be affected. Likewise, the more times the object changes direction the more the speed will be affected. It appears that this is what happens when a bullet hits ceramic spheres inside ballistic panel. The hardness, strength and the collective mass and density of ceramic layer is much greater then the bullet. Consequently, when the bullet enters ballistic panel, ceramic layer forces it to change direction. Within a microsecond ballistic panel has affected the velocity of the bullet by redirecting its path.

Isaac Newton's Third Law is formally stated as "For every action, there is an equal and opposite reaction." A force is a push or pull upon an object which results from its interaction with another object. Forces result from interactions. Some forces are the result of contact interactions (normal, frictional, tensional and applied forces are example of contact forces). According to Newton, whenever objects A (ceramic spheres) and B (bullet) interact with each other, they exert force upon each other. Therefore, the result is frictional force to one degree or another. The frictional force acts to slow down and re-direct the bullet.

This frictional force also produces intense heat. This heat appears to break the bullet apart. By breaking apart the bullet, the bullet's surface area is increased. Increasing the surface also increases the amount of contact interaction between objects A and B. Once the outer layer is stripped from the bullet, the intense heat appears to melt the softer lead interior, further reducing the overall mass of the bullet and breaking it apart. Core 12 appears to contain, absorb and dissipate any resulting force, including forces transferred from the bullet to ceramic layer 14.

The following describes further physics that explain how ballistic panel 10 works. A moving bullet that is about to hit an armor plate has a certain amount of kinetic energy. The job of the armor is to absorb this energy before the bullet penetrates the armor. In physical terms, in order for the armor to stop a bullet, frictional forces between the armor and the bullet must do work on the bullet whose magnitude equals the kinetic energy of the bullet. From elementary physics:

work=force*(distance traveled by the bullet)

The more work the armor can do on the bullet, the more kinetic energy it can absorb. Clearly, work can be increased if you can increase the frictional force, or increase the distance the bullet travels, or both. Obviously the distance can be increased simply by making the armor thicker.

FIG. 16 illustrates the situation where a bullet enters a piece of conventional armor. It is assumed that the bullet goes straight, and is brought to a complete halt after traveling a distance "d", which is the thickness of the armor. The thin arrow pointing up is the path of the bullet; the thick arrows labeled "N" represent the force of the armor against the case of bullet. Note that these are perpendicular ("normal") to the casing of the bullet. The short, thin arrows pointing down are the force of friction. Recall that the normal force is what gives rise to the friction force, the magnitudes of these forces being related by the coefficient of friction "μ" between the two materials: f=μN. Since the magnitude of the work done on the bullet by the frictional force is the same as the original kinetic energy of the bullet, a simple equation can be set up to find the thickness "d" that is needed to prevent penetration:

$$fd = \frac{1}{2}mv^2 \rightarrow d = \frac{mv^2}{2f} \quad [\text{"}m\text{" = mass of the bullet}]$$

Alternatively, the equation on the left can be solved for the maximum velocity of a bullet that could be stopped by a thickness "d" of the armor:

$$v = \sqrt{\frac{2fd}{m}}$$

or, the equation can be solved for the biggest mass that could be stopped by that thickness:

$$m = \frac{2df}{v^2}$$

In either case, the formulas show that if either "d" or "f" is made larger a faster bullet of a given mass can be stopped, or a heavier bullet traveling at a given speed can be stopped.

Now imagine that the armor could change the direction of the bullet immediately after the bullet pierces the outside. FIG. 17 shows a simplified situation: the bullet follows the arc of a circle whose radius is the thickness of the armor. Clearly, the distance that the bullet travels along the arc is greater than the thickness (about 1.57 times greater in this simplified case). Thus, forcing the bullet to change its direction is accomplishes the goal of increasing "d".

As before, the normal forces give rise to the friction forces. However, because the bullet is now traveling in a circular path, we need to consider the effect of the centripetal force (indicated by the large arrow). Centripetal force is always present for circular motion, and is directed to the center of the circle. From FIG. 17, we can see that this extra force is also perpendicular to the bullet's direction. Thus, there is another source of frictional force; "f" has been increased.

In the case of ballistic panel 10, there may be multiple changes of directions affected on the bullet by ceramic layer 14. Each change of direction may cause a further frictional force to be exerted on the bullet, helping to slow it down further.

The following is an exemplary description of how an embodiment of ballistic panel 10 works. A high-velocity bullet approaches ballistic panel 10 and penetrates outer coating 18 of ballistic panel 10. At impact, bullet's path is perpendicular to ballistic panel 10. The bullet impacts ceramic spheres 28 that make up ceramic layer 14 in this embodiment. Bonding media 16 reduces the displacement of ceramic spheres 28 away from the bullet. Some of ceramic spheres 28 break up on impact. Ceramic spheres 28 begin to grind the bullet as the bullet on impact. As described above, a significant frictional force is generated due to these impacts.

Outer coating 18 seals up behind the bullet as the bullet completely penetrates outer coating 18. As explained above, this is due to the elastic nature of outer coating 18. This self-healing helps to contain ceramic spheres 28, enabling ballistic panel 10 to withstand multiple hits to the same area.

The frictional force generated by the impacts of the bullet with ceramic spheres 28 generates extreme heat. The heat and the frictional force act on the bullet to break apart the jacket of the bullet, exposing the softer, lead inner layer of the bullet. As a result of these forces, the path of the bullet may no longer be perpendicular to ballistic panel 10. In other words, forces exerted on the bullet may change its direction.

The continuing frictional forces being exerted on the bullet generate greater and greater heat. This heat melts the softer, lead inner layer of the bullet. As the bullet penetrates further into ballistic panel 10, it may continue to change direction and to further dissipate as the lead is turned molten. Core 12 appears to contain the affects of the bullet within the affected node cell 26 of core 12. Force is transferred to core 12 from ceramic layer 14. This force transfer further dissipates the force of the bullet, as the force is communicated along the structure (protrusions 22) of core 12, to ceramic layer 14 on the non-impact side of ballistic panel 10, and to backing 20 or the material on which ballistic panel 10 is mounted. The remnants of the bullet may come to rest in node cell 26 of core 12. These remnants and the broken apart ceramic spheres 28 are contained within node cell 26 by bonding media 16 and the self-healed outer coating 18.

As discussed above, ballistic panel 10 may comprise a variety of size and shape cores 12 and ceramic layers 14. Similarly, ceramic layer 14 may include a variety of size and shape ceramic shapes (ceramic components). With reference now to FIGS. 13A-13C, shown are alternative embodiments of ceramic layer 14 and core 12. FIG. 13A illustrates a cylinder-shaped ceramic component or ceramic cylinder 50. When used with certain cores 12, ceramic cylinders 50 enable more efficient stacking and packing of ceramic layer 14, with minimal wasted space. As noted above, ceramic layer 14 is not limited to particular ceramic shapes, but may be a variety of shapes chosen to best fit applications of ballistic panel 10.

FIGS. 13B and 13C illustrate cores 12 designed to be used with ceramic cylinders 50. As noted above, core 12 is not limited to specific tetrahedron- and octahedron-like shapes or specific octet-truss shapes. Core 12 may be modified to work with ceramic cylinders 50 and other non-spherical ceramic shapes. Core 12 should be designed so that it distributes force well, provides substantial structural strength when incorporated in ballistic panel 10, and contains ceramic layer 14 and affects of ballistic projectiles and explosive forces incident on ballistic panel 10. In other words, core 12 shape may be modified so long as ballistic panel 10 incorporating core 12 performs as described herein.

With specific reference now to FIG. 13B, shown is a cross-section view of stacked layers of ceramic cylinders 50 and two corresponding cores 12 configured to be used with ceramic cylinders 50. As shown, core 12 is shaped so that one ceramic cylinder 50 fits within each node cell 26. Each ceramic cylinder 50 may tightly fit or pack within node 24 of core 12. Alternatively, core 12 may be shaped so that a plurality of ceramic cylinders 50 may fit within each node cell 26. FIG. 13B illustrates how ceramic cylinders 50 and corresponding cores 12 may be used to stack multiple cores 12 and ceramic layers 14 within one ballistic panel 10. This stacking provides significant flexibility and increased applications for the end use ballistic panel 10. Also shown is backing 20. Outer layer 18 may be applied to the combination of cores 12, ceramic layers 14 and backing 20 shown in FIG. 13 to create a single ballistic panel 10. Ballistic panel 10 may also comprise multiple ceramic layers 14 stacked with a single core 12.

With specific reference now to FIG. 13C, shown is a partial perspective cross-section view illustrating a single layer of core 12 and ceramic cylinders 50. In the embodiment shown, multiple ceramic cylinders 50 pack snugly within node cell 26 of core 12. Each ceramic cylinder 50, and hence node cell 26, may extend the full length of core 12 in the shown direction X. Alternatively, core 12 may be configured to include multiple node cells 26 in the direction X. In other words, core 12 may shaped in an octet-truss like shape accepting ceramic cylinders 50. In this alternative embodiment, ceramic cylinders 50 would not extend in the direction X the length of core 12, but would rather only extend in the direction X a\ length sufficient to fit nodes 24 and node cells 26. As shown in FIG. 13C, core 12 also forms casting walls 30. Only a portion of core 12 is shown here.

Not only is core 12 not limited to specific tetrahedron- and octahedron-like shapes or specific octet-truss shapes, but core 12 is not limited to a rigid form either. Packing of nodes 24 and node cells 26 of core 12 closer together permits a greater flexibility of core 12. For example, if node-less cells 32 are eliminated from core 12, nodes 24 and node cells 26 are packed closer together. This closer node cell 26 packing enables core 12 to be flexible and bendable (more flexible materials for core 12 may be chosen to increase flexibility and bendability). The embodiments of core 12 shown in FIGS. 13B-13C for use with ceramic cylinders 50 may be more flexible and bendable because of closer packed node cells 26 and an absence of node-less cells 32.

A flexible and bendable core 12, in turn, permits ballistic panel 10 to be configured and molded as rounded or curved shapes. For example, ballistic panel 10 may be configured as a cylinder or even a cone-like shape. Ballistic panel 10 may be molded to fit around curved surfaces, such as curved vehicle panels or other curved structures. Enabling ballistic panel 10 to be rounded and curved increases possible applications of ballistic panel 10 many-fold. The following is a description of one such novel application utilizing a rounded and curved ballistic panel 10.

With reference now to FIGS. 14A-14B, shown are cross-sectional views of secure can 60, which may incorporate a curved ballistic panel(s) 10. Protecting public locations has become an international problem. Explosive devices placed in public trash receptacles are a major public safety threat. Officials have tried removing public trash cans or replacing them with bulky concrete structures but this has caused other issues such as trash being left on the street or difficulty in removing trash from the bulky concrete receptacle (in some cases a crane is needed).

Secure can 60 can be used in any public place as an effective containment device. Secure can 60 looks like an ordinary trash can and can be easily emptied. However, if a bomb is placed in secure can 60, the ballistic panel 10 and core 12 technology minimizes the effects of any explosion, absorbing the resulting force. Secure can 60 is designed specifically for blast suppression, trapping fragments and reducing overall heat and dust fallout. As an option, secure can 60 may include a Nuclear-Biochemical-Chemical ("NBC") decontaminate stored in its lid and/or walls that would be released at the point of detonation. NBC decontaminate may be a liquid, powder, or other solid decontaminate formulated to decontaminate nuclear, biological and/or chemical agents released by an explosion. NBC decontaminates are known to those of skill in the art; one decontaminate is chlorine dioxide. The energy from a blast would launch the decontaminate.

With references to FIG. 14A, shown is partial cross-sectional perspective view of secure can 60. The view shows a cross-section of the walls of secure can 60. As shown, secure can 60 walls comprises inner liner 62, curved ballistic panel 64, an optional NBC decontaminate layer 66, and outer layer 68. Secure can 60 preferably also comprises lid (see FIG. 14B) and trim ring (see FIG. 14B). The base or foot of secure can 60 may also comprise inner liner 62, ballistic panel 64, an optional NBC decontaminate layer 66 and an outer layer 68. The base may be formed as part of the walls or separately and later attached to walls.

Inner liner 62 may be made out of polyethylene or other similar and appropriate material. Curved ballistic panel 64 may include one or more tetrahedron-shaped core(s) 12 in any shape, bent or flexed in a cylinder and ceramic layer 14 or other filler (e.g., sand or ceramic spheres 28). Curved ballistic panel 64 may include a single core 12 that extends the full height of secure can 60 all the way around circumference of secure can 60. Alternatively, curved ballistic panel 64 may include multiple cores 12, extending around circumference of secure can 60, stacked vertically on top of one another to match height of secure can 60 or multiple cylindrical cores 12 that only extend part way around circumference of secure can 60. Core 12 may be made out of ABS plastic. Core 12 may be filled in with ceramic layer 14, as described herein, or with another readily available filler such as sand. In FIG. 14A, core 12 is filled in with ceramic layer 14. Outer layer 66 may be made out of polyethylene or other similar and appropriate material. NBC decontaminate layer, if included, may include a NBC decontaminate that is placed between curved ballistic panel 64 and outer layer 68. NBC decontaminate layer may be a liquid, powder, or other solid decontaminate formulated to decontaminate nuclear, biological or chemical agents released by an explosion.

After assembly, inner liner 62, curved ballistic panel 64, NBC decontaminate 66, and outer layer 68 may be coated with an elastomeric, expandable, polyurethane, solvent free 100% solids polymer layer (e.g., a Rhinocast™ truck bed liner product) similar to outer coating 18 described above. This polymer layer can be successfully sprayed on in an even layer and provides ideal results. Other materials may be used that provide the same or similar performance, such as other two component chemical processing systems that include pouring a polyurethane into a mold that becomes tack free in seconds. Trim ring covers the top of inner liner 62/outer layer 68 so they are not visible and may be made out of ABS plastic.

With reference now to FIG. 14B, shown is a partial cross-sectional view of secure can 60. This view shows only a cross-section of lid 70, not a cross-section of receptacle portion of secure can. Shown is lid 70 on top of secure can 60. Lid 70 is placed on top of secure can 60 (on top of trim ring 74) and may be made out of polyethylene and can incorporate additional features. For example, lid 70 may include NBC decontaminate layer 72. As mentioned above, NBC decontaminate layer may be a liquid, powder, or other solid decontaminate formulated to decontaminate nuclear, biological or chemical agents released by an explosion. Secure can 60 is preferably configured to direct explosive blast upwards through lid 70. NBC decontaminate layer 72 may be activated by explosive blast directed upward through lid 70 and may decontaminate and NBC materials contained in blast. Lid 70 may also include ballistic panel (not shown) to further contain and reduce affects of blast.

Lid 70 with NBC decontaminate layer 72 is a unique combination of features itself. Lid 70 may be incorporated into other secure trash cans and receptacles other than secure can 60. In other words, lid 70 may also be used with trash cans that use means other than ballistic panel 10 to contain an explosive blast (e.g., concrete, steel, etc.). Since most secure trash cans and receptacles are configured to shape explosive blasts upward, lid 70 may be quite useful in decontaminating any NBC elements in such blasts.

As discussed above, ballistic panel 10 may be used in a variety of applications. Among the many possible applications is the use of ballistic panels 10 as building blocks or as components of building blocks or other structural components used in constructing structures. Ballistic panel 10 technology may be adapted for building structures, protecting government facilities, airports and important landmarks. Such applications may incorporate ballistic panels 10 configured as described above with core 12, ceramic layer 14, bonding media 16, and outer coating 18. Other applications may incorporate ballistic panels 10 that comprise core 12 alone with some filler (e.g., sand, other ceramic media, fine-particle clay, etc.) that is easily applied in the "field" (e.g., in a war zone, security zone, rapid-deployment area, etc.) by, e.g., soldiers or security personnel. Such applications may provide for adding outer coating 18 in the field as well.

Figure 15A:
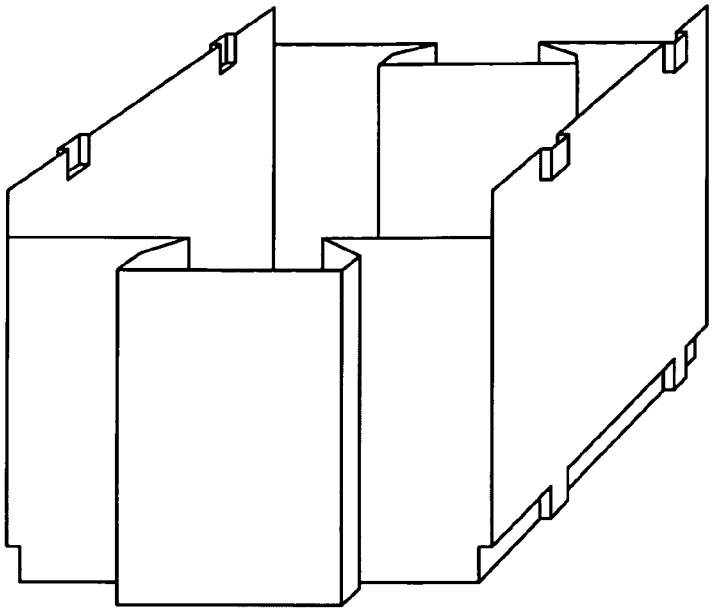

With reference now to FIGS. 15A-15D, shown are embodiments of such a structural application of ballistic panel 10. FIG. 15A shows a perspective view of building block 80 in which ballistic panels 10 are inserted. Building blocks 80 may be used for permanent structures, but are particularly useful for utilizing ballistic panel 10 technology to provide soldiers, and others in the field, with protective barriers for increased survivability. Building blocks 80 are durable, interlocking and easy to assemble. Building blocks 80 are lightweight, allowing for rapid deployment. Embodiments of building blocks 80 are constructed from ¼" ABS plastic in the shape of an interlocking box, as shown in FIG. 15A. Other materials and shapes may be used for building blocks 80.

Figure 15B:
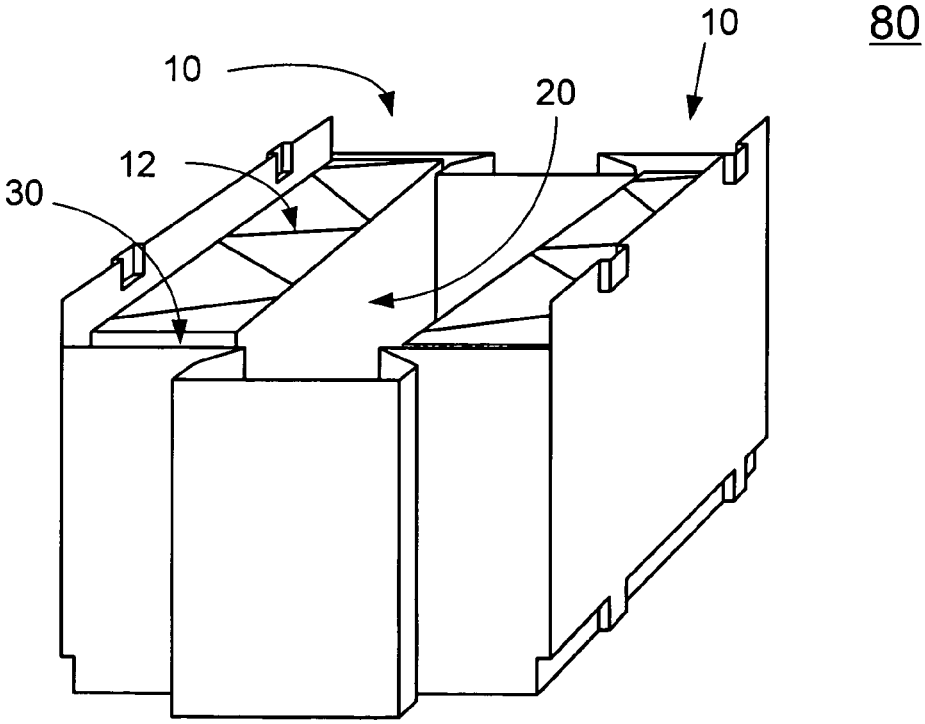

With reference now to FIG. 15B, shown is building block 80 with two ballistic panels 10 inserted therein. In the embodiment shown, two ballistic panels 10 are inserted into building block 80, with space for additional ballistic panel 10 in the middle of building block 80. Ballistic panels 10 shown here comprise three-dimensional tetrahedron cores 12. Cores 12 may be formed from ABS plastic or other material. Cores 12 may be enclosed by two backings 20 (or covers), one on each side of core 12, and casting walls 30 on ends of core 12 which are not visible in FIG. 15B (i.e., facing building block 80 walls). Backings 20 (or covers) and casting walls 30 may be formed as part of core 12 or formed separately and attached to core 12 (e.g., bonded to core 12) or simply inserted into building block 80 next to core 12. If formed separately, backing 20 may be constructed from steel plate, aluminum, or other material. Alternatively, cores 12 alone may be inserted into building block 80. The top of cores 12 are preferably left open and exposed, as shown in FIG. 15B, so that a filler may fill in the ballistic panels 10, filling in node cells 26 of core 12.

Figure 15C:
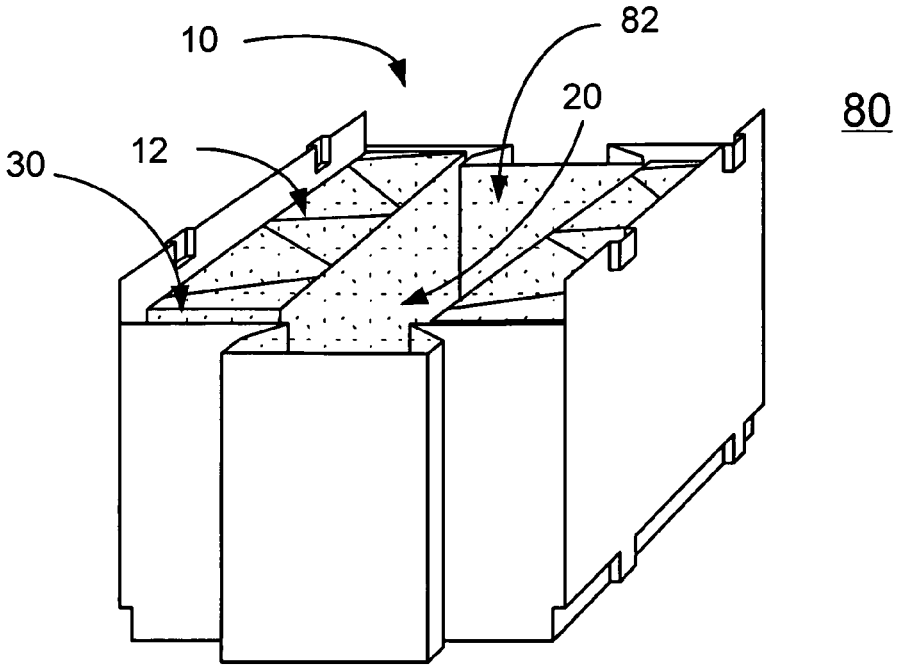

After ballistic panels 10 (e.g., cores 12) are inserted into building block 80, filler 82 is added to ballistic panels 10 and building block 80. Filler 82 may be sand or other ceramic media. With reference now to FIG. 15C, shown is building block 80, with two ballistic panels 10 inserted therein, filled with filler 82. Filler 82 may be poured into ballistic panels 10 and building block 80 through known means, such as simply shoveling sand into the building block 80. Preferably, filler 82 fills the entire building block 80, completely filling all node cells 26 in core 12 and spaces between inserted ballistic panels 10. The exposed top of building block 80 (i.e., top of ballistic panels 10 and filler 82) may be coated with an elastomeric, expandable, polyurethane, solvent free 100% solids polymer layer (e.g., a Rhinocast™ truck bed liner product) similar to outer coating 18. This polymer layer can be successfully sprayed on in an even layer and provides ideal results. Other materials may be used that provide the same or similar performance, such as other two component chemical processing systems that include pouring a polyurethane into a mold that becomes tack free in seconds.

Figure 15D:
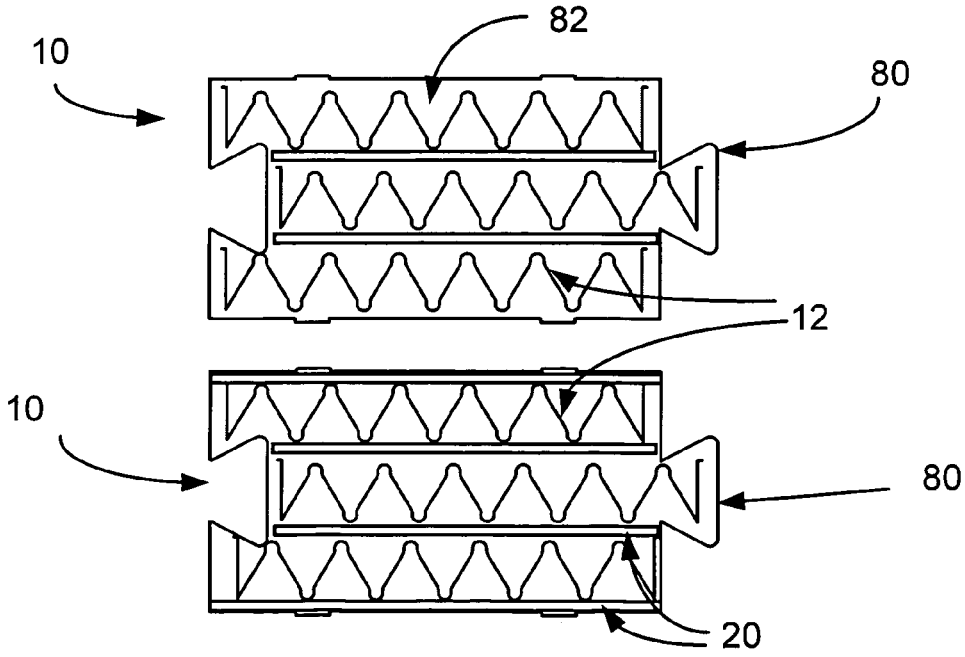

With reference now to FIG. 15D, shown is a top, cross-sectional view of building blocks 80, each fully assembled with three ballistic panels 10 and filler 82. Assembled as such, building blocks 80 with ballistic panels 10 and filled with filler 82 provide lightweight, interlocking blocks for building defensive structures, such as defensive bunkers in combat, that can be easily and quickly assembled. As illustrated, all that is needed to assemble these blocks is building blocks 80, ballistic panels 10 (e.g., just core 12), and readily available filler 82 such as sand. Assembled as such, building blocks 80 provide superior protection against small arms fire, IED threats and high velocity projectiles. Building blocks 80 with ballistic panels 10 and filler 82 operate similarly to ballistic panels 10 described above. For example, filler 82 creates friction for projectiles, heating up and grinding down projectile, and core 12 absorbs and translates force from projectiles, eventually containing projectile effects within node cell 28.

As shown in FIGS. 15A-15D, each building block 80 may include a receiving end on a first end of the building block and a corresponding insertion end on an opposing second end of the building block. The receiving end and insertion end are for interlocking the building block 80 with other building blocks 80. As shown, the insertion end of building block 80 is sized to fit within and interlock with the receiving end of (another) building block 80. In this manner, building blocks 80 may interlock with other building blocks 80. In other words, the insertion end of a first building block 80 may be inserted into the receiving end of a second building block 80 while the insertion end of the second building block 80 may be inserted into the receiving end of a third building block 80, and so on until a structure is formed.

Building blocks 80 and ballistic panels 10 designed for use therewith may be sold or provided separately or as a kit. Provided as a kit, an end user simply needs to add readily available filler and assemble, and building blocks 80 may be used to construct a protective structure.

Yet another application of ballistic panel 10 may use ballistic panels 10 illustrated and described above with reference to FIGS. 1A-2D. For example, rectangular (or other quadrilateral) shaped ballistic panels 10 may be combined to form a multi-panel, portable ballistic shield. Such a ballistic shield provides an effective barrier against gun-fire and fragments from explosive devices. The multi-panel, portable ballistic shield may be used as a portable fighting wall for use by military and security forces. For example, a sniper may set up a two-panel ballistic shield from which he can snipe behind, protected from shrapnel and small-arms fire. Such a ballistic shield may be used for blast suppression.

Such a ballistic shield may be constructed from two or more ballistic panels 10 that are connected together with hinges, Velcro, or other similarly hinged or pivoting/flexible connection on each ballistic panel 10. So connected, ballistic panels 10 comprising the ballistic shield may be positioned at angles to one another so that the ballistic shield may stand upright. For example, two ballistic panels 10 of a ballistic shield may stood up on end and be angled at a 45 degree angle to one another, providing support to each other. The more ballistic panels 10 included in the ballistic shield, the better able to ballistic shield is to stand upright. The ballistic shield may also include attachable braces or supports that can be attached to the ballistic panels, further bracing and supporting the ballistic shield when it is stood upright.

Preferably, the hinges, Velcro or other connections may be easily disconnected so that ballistic panels 10 comprising ballistic shield may be easily taken apart. This enables the ballistic shield to be easily disassembled. Disassembled as such, ballistic panels 10 comprising the ballistic shield may be stacked and easily stored, e.g., in a trunk of a car. Furthermore, a single ballistic panel 10 may be detached from the ballistic shield and used as a portable, personal shield. For example, if a military or security personnel had to go from a prone fighting position behind a ballistic shield to on-foot pursuit of a target, he or she could detach one ballistic panel 10 from ballistic shield and carry it as a personal shield. As such, ballistic panels 10 of ballistic shield may include straps or strapping 40, as described above with reference to FIGS. 3-5B.

Many other applications of ballistic panel 10 are apparent to one of skill from the description herein. For example, ballistic panels 10 may be incorporated into wood or steel frame walls. Ballistic panels 10 may be incorporated as backing behind decorative façades, e.g., providing protection from blasts and small-arms fire where there would otherwise be known. Core 12 may be incorporated separately into many useful applications and structures, as described herein. Ballistic panels 10 may be easily assembled on site from cores 12 and readily available materials such as sand. The ballistic panel 10 technology described herein provides combination of protection and useful application not seen in any other protective technology.

The terms and descriptions used herein are set forth by way of illustration only and are not meant as limitations. Those skilled in the art will recognize that many variations are possible within the spirit and scope of the invention as defined in the following claims, and their equivalents, in which all terms are to be understood in their broadest possible sense unless otherwise indicated.

The invention claimed is:

1. An apparatus for constructing protective structures, comprising:

a building block, wherein the building block is shaped to interlock with other building blocks in that the building block includes an insertion end at a first end of the building block and a receiving end at a second end of the building block, the insertion end sized to fit within the receiving end so that the insertion end may be inserted within a receiving end of another building block to interlock the building blocks;

one or more ballistic panels configured to fit within the building block, wherein each ballistic panel comprises a three-dimensional core that acts as a truss for the ballistic panel, provides structural support for the ballistic panel and approximates an octet truss; and a filler, wherein the filler fills in spaces defined by each three-dimensional core an any empty spaces in the building block, wherein the one or more ballistic panels and the filler are inserted into the building block.

2. The apparatus of claim 1 wherein the filler is ceramic.

3. The apparatus of claim 2 wherein the filler is a ceramic grinding media and bonding media that bonds the ceramic grinding media.

4. The apparatus of claim 3 wherein the ceramic grinding media are substantially solid ceramic spheres or cylinders.

5. The apparatus of claim 1 wherein the filler is sand.

6. A wall comprising a plurality of the apparatus of claim 1.

7. A building block comprising:

an exterior shell with a first side, a second side, a first end and a second end between the first side and the second side, and defining an open top and bottom, wherein the first end is shaped as a receiving end and the second end is shaped as an insertion end that is sized to fit within the receiving end so that the building block may interlock with similar building blocks by inserting the insertion end into a substantially similar receiving end of another building block or by receiving a substantially similar insertion end of another building block within the receiving end of the building block;

one or more ballistic panels inserted within the exterior shell, wherein each ballistic panel comprises a tetrahedron-shaped three-dimensional core that that defines node cells;

a filler, wherein the filler fills in the node cells defined by each three-dimensional core and any empty spaces in the building block; and an self-healing, elastomeric polymer coating surrounding the one or more ballistic panels and the filler within the exterior shell and covering at least the open top and bottom of the exterior shell.

8. The building block of claim 7 further comprising a backing inserted between the one or more ballistic panels and an interior surface of the exterior shell.

9. The building block of claim 8 wherein the backing is fabricated from a metal.

10. The building block of claim 7 wherein the filler is a ceramic grinding media.

11. The secure trash can of claim 10 wherein the ceramic grinding media includes substantially solid ceramic spheres or cylinders.

12. A kit comprising a plurality of building blocks of claim 7.

* * * * *